US009243365B2

(12) United States Patent
Townsend et al.

(10) Patent No.: US 9,243,365 B2
(45) Date of Patent: Jan. 26, 2016

(54) RELEASE AIDS WITH ADJUSTABLE CLOUD POINTS FOR CREPING PROCESSES

(71) Applicant: Georgia-Pacific Chemicals LLC, Atlanta, GA (US)

(72) Inventors: David F. Townsend, Grayson, GA (US); Cornel Hagiopol, Lilburn, GA (US)

(73) Assignee: Georgia-Pacific Chemicals LLC, Atlanta, GA (US)

( * ) Notice: Subject to any disclaimer, the term of this patent is extended or adjusted under 35 U.S.C. 154(b) by 0 days.

(21) Appl. No.: 14/576,789

(22) Filed: Dec. 19, 2014

(65) Prior Publication Data

US 2015/0176212 A1 Jun. 25, 2015

Related U.S. Application Data

(60) Provisional application No. 61/918,906, filed on Dec. 20, 2013.

(51) Int. Cl.
*D21H 21/14* (2006.01)
*B31F 1/12* (2006.01)

(52) U.S. Cl.
CPC ..... *D21H 21/146* (2013.01); *B31F 1/126* (2013.01)

(58) Field of Classification Search
USPC ..... 162/111
IPC ..... D21H 21/14; B31F 1/12
See application file for complete search history.

(56) References Cited

U.S. PATENT DOCUMENTS

| | | | | |
|---|---|---|---|---|
| 1,856,567 | A | | 5/1932 | Kleinert et al. |
| 2,525,433 | A | | 10/1950 | Voet |
| 2,595,935 | A | | 5/1952 | Daniel, Jr. et al. |
| 2,680,113 | A | | 6/1954 | Adler et al. |
| 2,690,973 | A | | 10/1954 | Voet |
| 2,926,116 | A | | 2/1960 | Keim |
| 3,058,873 | A | | 10/1962 | Keim et al. |
| 3,094,515 | A | | 6/1963 | Keirstead et al. |
| 3,158,520 | A | | 11/1964 | Edmonds et al. |
| 3,248,353 | A | | 4/1966 | Coscia |
| 3,503,762 | A | | 3/1970 | Remer |
| 3,585,104 | A | | 6/1971 | Kleinert |
| 3,655,506 | A | | 4/1972 | Baggett |
| 3,726,850 | A | | 4/1973 | Detroit |
| 3,769,272 | A | | 10/1973 | Hintz |
| 3,772,076 | A | | 11/1973 | Keim |
| 3,841,887 | A | | 10/1974 | Falkehag et al. |
| 4,100,016 | A | | 7/1978 | Diebold et al. |
| 4,131,564 | A | | 12/1978 | Dilling |
| 4,184,845 | A | | 1/1980 | Lin |
| 4,308,203 | A | | 12/1981 | Lin |
| 4,355,996 | A | | 10/1982 | Dilling et al. |
| 4,470,876 | A | | 9/1984 | Beaupre et al. |
| 4,740,591 | A | | 4/1988 | Dilling et al. |
| 4,764,596 | A | | 8/1988 | Lora et al. |
| 5,338,807 | A | | 8/1994 | Espy et al. |
| 5,490,903 | A | * | 2/1996 | Chen ..... A61K 8/0208 162/111 |
| 5,660,687 | A | * | 8/1997 | Allen ..... B31F 1/12 156/183 |
| 5,670,571 | A | | 9/1997 | Gabrielson et al. |
| 5,833,806 | A | * | 11/1998 | Allen ..... B31F 1/12 162/111 |
| 2008/0280787 | A1 | | 11/2008 | Rediger et al. |
| 2011/0294991 | A1 | | 12/2011 | Lake et al. |

FOREIGN PATENT DOCUMENTS

| | | |
|---|---|---|
| CA | 979579 | 12/1975 |
| WO | 92/18557 | 10/1992 |
| WO | 93/21260 | 10/1993 |
| WO | 94/24192 | 10/1994 |
| WO | 2005/062800 | 7/2005 |
| WO | 2006/031175 | 3/2006 |
| WO | 2011/150508 | 12/2011 |

* cited by examiner

*Primary Examiner* — Mark Halpern
(74) *Attorney, Agent, or Firm* — Ram W. Sabnis

(57) ABSTRACT

Methods for making cellulosic fiber webs using release aids containing one or more polyethers and one or more hydrophilic polymers. In at least one specific embodiment, a release aid having a first temperature can be applied to a drying surface having a second temperature. The second temperature can be greater than the first temperature. The release aid, in an aqueous solution that includes water and about 3 vol % of the release aid based on the total volume of the release aid and water, can have a cloud point greater than the first temperature and less than the second temperature at a pressure of 100 kPa. The method can also include adhering a cellulosic fiber web to the drying surface by contacting the cellulosic fiber web to the drying surface. The method can also include dislodging the cellulosic fiber web from the drying surface.

20 Claims, No Drawings

RELEASE AIDS WITH ADJUSTABLE CLOUD POINTS FOR CREPING PROCESSES

CROSS-REFERENCE TO RELATED APPLICATION

This application claims priority to U.S. Provisional Patent Application No. 61/918,906, filed on Dec. 20, 2013, which is incorporated by reference herein.

BACKGROUND

1. Field

Embodiments described generally relate to release aids and methods for making and using same. More particularly, the embodiments described relate to release aids containing one or more polyethers and one or more hydrophilic polymers for use in creping cellulosic fiber webs.

2. Description of the Related Art

The manufacture of paper is generally carried out by producing an aqueous slurry of cellulosic fibers and a variety of chemicals and subsequently removing most of the water to form a thin paper web. The structural integrity of the paper arises in large part from mechanical entanglement of the cellulosic fibers in the web and hydrogen bonds that form between the cellulosic fibers. With paper intended for use as tissue and towel products such as facial tissue, bathroom tissue, paper towels, and napkins, the level of structural integrity arising from the paper-making process conflicts somewhat with the degree of perceived softness that is necessary for consumer acceptance of such products.

The most common method for increasing the perceived softness of tissue and towel products is to "crepe" the paper. The creping action can impart a fine, rippled texture to the sheet, increase the bulk of the sheet, improve softness of the sheet, and/or improve absorbency of the sheet. Creping can be accomplished by adhering a moist, cellulosic paper web to a surface of a rotating thermal drum commonly known as a Yankee dryer that has been sprayed with a creping adhesive, generally in the form of an aqueous solution, emulsion, or dispersion. The surface of the Yankee dryer is continuously sprayed with the creping adhesive while the cellulosic web is applied and dried by hot air impinging on the exposed side of the paper and conductive heat is transferred from the drum. As the paper dries, hydrogen bonds form between the fibers creating a flat and dense web morphology. The paper is then scraped backwardly upon itself and off of the Yankee dryer by means of a flexible blade, called a "doctor" blade or a "creping" blade to provide a creped product. This creping process causes a substantial number of inter-fiber bonds to break, altering the physical-chemical characteristics of the web and increasing the perceived softness of the resulting creped product.

The art of obtaining good crepe quality relies on maintaining the proper level of adhesion between the paper web and the surface of the Yankee dryer. Inadequate adhesion can result in poor or non-existing creping or require lower speed operation due to slow drying, while excessive adhesion can lead to poor sheet quality or cause the sheet to break. Cellulosic webs that are insufficiently adhered to the Yankee dryer can impact the control of the web as it travels between the creping blade and the winder upon which a roll of the paper is being formed, causing problems in forming a uniform roll of paper. For example, a loose sheet between the creping blade and the roll can cause wrinkles, foldovers, and weaving of the edges of the sheet in the rolled-up paper, adversely affecting subsequent operations of paper manufacture. Release aids can alter the properties of the adhesive and further provide lubrication to the doctor blade, and influence the release of the paper web from the Yankee dryer, all of which can affect the properties of the creped product. Considerable effort has been spent trying to adjust the balance between the adhesion and the release of the web, while maintaining other conventional parameters that influence the creping process, such as web wetness and creping blade angle.

There is a need, therefore, for improved release aids that can provide more control over the adhesion/release balance of cellulosic fiber webs on the surface of the dryer and methods for making and using same.

SUMMARY

Methods for making a cellulosic fiber web using release aids containing one or more polyethers and one or more hydrophilic polymers are provided. In at least one specific embodiment, a release aid having a first temperature can be applied to a drying surface having a second temperature. A cellulosic fiber web can be adhered to the drying surface by contacting the cellulosic fiber to the drying surface. The method can also include dislodging the cellulosic fiber web from the drying surface. The second temperature can be greater than the first temperature. The release aid, in an aqueous solution that includes water and about 3 vol % of the release aid based on the total volume of the release aid and water, can have a cloud point that is greater than the first temperature and less than the second temperature at a pressure of 100 kPa. The release aid can include a polyether and a hydrophilic polymer. The polyether can include a polyethylene glycol, a polypropylene glycol, a copolymer of propylene glycol and ethylene glycol, a blend of polypropylene glycol and polyethylene glycol, an alcohol polyether, an alkyl phenol polyether, or any mixture thereof. The hydrophilic polymer can include a polyvinyl alcohol, a starch, a tannin, a lignin, a novolac resin, a polyacrylic acid, a copolymer of acrylic acid, a copolymer of methacrylic acid, a copolymer of itaconic acid, a copolymer of maleic anhydride, carboxymethyl cellulose, or any mixture thereof.

In at least one other specific embodiment, a creping composition having a first temperature can be applied to a drying surface having a second temperature. A cellulosic fiber web can be adhered to the drying surface by contacting the cellulosic fiber web to the drying surface. The method can also include dislodging the cellulosic fiber web from the drying surface. The second temperature can be greater than the first temperature. The creping composition can include a release aid and an adhesive. The release aid, in an aqueous solution that includes water and about 3 vol % of the release aid based on the total volume of the release aid and water, can have a cloud point that is greater than the first temperature and less than the second temperature at a pressure of 100 kPa. The release aid can include a polyether and a hydrophilic polymer. The polyether can include a polyethylene glycol, a polypropylene glycol, a copolymer of propylene glycol and ethylene glycol, a blend of polypropylene glycol and polyethylene glycol, an alcohol polyether, an alkyl phenol polyether, or any mixture thereof. The hydrophilic polymer can include a polyvinyl alcohol, a starch, a tannin, a lignin, a novolac resin, a polyacrylic acid, a copolymer of acrylic acid, a copolymers of methacrylic acid, a copolymer of itaconic acid, a copolymer of maleic anhydride, carboxymethyl cellulose, or any mixture thereof. The adhesive can include a polyamine-epihalohydrin resin, an acrylonitrile copolymer grafted onto cellulose, a polyvinyl alcohol, an aromatic polyamidoamine, a polyvinyl amine, a glyoxalated polyacrylamide, a polyamine, a copolymer of styrene-methacrylic acid, or any mixture thereof.

In at least one specific embodiment, a creped product can include a creped cellulosic fiber web that can include a creping composition containing an at least partially cured adhesive. Prior to curing, the creping composition can include a release aid and an adhesive. The release aid can include a polyether and a hydrophilic polymer. The polyether can include a polyethylene glycol, a polypropylene glycol, a copolymer of propylene glycol and ethylene glycol, a blend of polypropylene glycol and polyethylene glycol, an alcohol polyether, an alkyl phenol polyether, or any mixture thereof. The hydrophilic polymer can include a polyvinyl alcohol, a starch, a tannin, a lignin, a novolac resin, a polyacrylic acid, a copolymer of acrylic acid, a copolymer of methacrylic acid, a copolymer of itaconic acid, a copolymer of maleic anhydride, a carboxymethyl cellulose, or any mixture thereof. The adhesive can include a polyamine-epihalohydrin resin, an acrylonitrile copolymer grafted onto cellulose, a polyvinyl alcohol, an aromatic polyamidoamine, a polyvinyl amine, a glyoxalated polyacrylamide, a polyamine, a copolymer of styrene-methacrylic acid, or any mixture thereof.

DETAILED DESCRIPTION

It has been has been surprisingly and unexpectedly discovered that release aids containing a mixture of one or more polyethers and one or more hydrophilic polymers offer an improved means to manage a creping process by allowing adjustments in cloud point. It has also been surprisingly and unexpectedly discovered that when the release aid is mixed with an adhesive to form a creping composition, the cloud point can influence a change in phase structure and glass transition temperature of the components that can provide improved adhesion, tack, rewetability, and/or release properties between the cellulosic fiber web and the surface of the dryer, e.g., the surface of a Yankee dryer. The ratio between the polyether and the hydrophilic polymer, the ratio between the adhesive and the release aid, the particular polyether and the particular hydrophilic polymer in the release aide, the water concentration, and/or the temperature can be adjusted to improve the performance of the creping process.

While not wishing to be bound by theory, it is believed that interpolymer complexes can form by hydrogen bonding between the hydrophilic polymer and the polyether, altering the solubility of these components and changing the cloud point of the release aid. The cloud point is the temperature at which a mixture starts to separate into two or more phases or states of matter becoming turbid. In the case of the polyether and the hydrophilic polymer, the cloud point can exhibit reverse solubility versus temperature behavior; hence, the components can "cloud out" when heated to a certain temperature. The particular temperature at which the components cloud out can depend, at least in part, on the particular polyether and hydrophilic polymer chosen. Furthermore, when the release aid is mixed with an adhesive, a change in phase structure and glass transition temperature of the components can occur under dryer operating conditions, e.g., Yankee dryer operating conditions. For example, it is believed that the reduced solubility of the polyether and the hydrophilic polymer can alter the glass transition temperature of the adhesive in the creping composition. When the creping composition changes in temperature or is diluted, a change in phase structure of the components can occur, creating an oil-like effect. This oil-like effect of can enhance or otherwise improve the release of the cellulosic fiber web from the surface of the dryer, e.g., the surface of a Yankee dryer.

The release aid can be formulated, made, or otherwise produced to provide an aqueous solution of the release aid having a desired or predetermined cloud point. The cloud point values of the aqueous solution of the release aid are for an aqueous solution that includes water and about 3 vol % of the release aid, based on the total volume of the release aid and water, at a pressure of 100 kPa. In one or more embodiments, the aqueous solution of the release aid can have a cloud point from a low of about 1° C., about 5° C., about 10° C., about 15° C., about 20° C., about 25° C., about 30° C., or about 35° C. to a high of about 50° C., about 60° C., about 70° C., about 80° C., about 90° C., about 95° C., or about 98° C. For example, the aqueous solution of the release aid can have a cloud point of about 1° C. to about 5° C., about 3° C. to about 8° C., about 5° C. to about 10° C., about 9° C. to about 15° C., about 12° C. to about 22° C., about 15° C. to about 25° C., about 20° C. to about 40° C., about 25° C. to about 45° C., about 31° C. to about 55° C., about 45° C. to about 65° C., about 60° C. to about 80° C., about 70° C. to about 95° C., about 80° C. to about 90° C., or about 75° C. to about 98° C. In another example, the aqueous solution of the release aid can have a cloud point of at least 25° C., at least 30° C., at least 35° C., at least 40° C., at least 45° C., at least 50° C., at least 55° C., at least 60° C., at least 65° C., at least 70° C., at least 75° C., or at least 80° C. In another example, the aqueous solution of the release aid can have a cloud point of less than 98° C., less than 95° C., less than 90° C., less than 85° C., less than 80° C., less than 75° C., less than 70° C., less than 65° C., less than 60° C., less than 55° C., or less than 50° C. In another example, the aqueous solution of the release aid can have a cloud point of at least 45° C., at least 50° C., at least 55° C., or at least 60° C. and less than 95° C., less than 90° C., less than 85° C., less than 80° C., less than 75° C., or less than 70° C.

The cloud point of the release aid can be measured according to the following procedure. About 50 ml of an aqueous solution of the release aid that includes water and about 3 vol % of the release aid, based on the total volume of the release aid and water, and a magnetic stir bar can be added to a 100 ml Pyrex beaker. The beaker can be placed in a temperature controlled water bath on top of a submersible magnetic stirrer. The probe for a digital thermometer can be inserted into the release aid in such a way as to not disturb the magnetic stir bar, and clamped into place. The water bath can be set for 20° C. to start. The stirring control can be engaged and the water bath temperature can be increased in increments of 5° C. for the first run to get an approximate idea or estimated cloud point of the release aid. As the mixture warms an observer can note the increase in temperature and visually detect at about what temperature the solution becomes cloudy. The bath can be returned to 20° C. for the next run. On subsequent runs the temperature of the bath can be set to 10° C. below the preliminary cloud point. After reaching equilibrium, the bath temperature can be increased in 1° C. increments and the observer can note the temperature at which cloudiness is observed.

The one or more polyethers and the one or more hydrophilic polymers can be mixed with one another at any desired ratio to produce the release aid. For example, a weight ratio of the polyether to the hydrophilic polymer in the release aid can be from a high of about 99:1, about 90:10, about 80:20, about 70:30, about 60:40, or about 50:50 to a low of about 40:60, about 30:70, about 20:80, about 10:90, or about 1:99. In another example, the weight ratio of the polyether to the hydrophilic polymer in the release aid can be about 99:1 to about 90:10, about 90:1 to about 80:20, about 80:20 to about 70:30, about 70:30 to about 60:40, about 60:40 to about 50:50, about 50:50 to about 40:60, about 40:60 to about 30:70, about 30:70 to about 20:80, about 20:80 to about 10:90, about 10:90 to about 1:99, or about 75:25 to about 65:35.

In one or more embodiments, the release aid can include from a low of about 1 wt %, about 5 wt %, about 10 wt %, about 15 wt %, about 20 wt %, about 25 wt %, about 30 wt %, about 35 wt %, about 40 wt %, or about 45 wt % to a high of about 55 wt %, about 60 wt %, about 65 wt %, about 70 wt %, about 75 wt %, about 80 wt %, about 85 wt %, about 90 wt %, about 95 wt %, or about 99 wt % of the polyether, based on the total weight of the polyether and the hydrophilic polymer. For example, the release aid can include about 20 wt % to about 80 wt %, about 30 wt % to about 70 wt %, about 40 wt % to about 80 wt %, about 50 wt % to about 70 wt %, about 60 wt % to about 80 wt %, about 65 wt % to about 75 wt %, about 60 wt % to about 70 wt %, about 70 wt % to about 90 wt %, about 40 wt % to about 60 wt %, about 75 wt % to about 80 wt %, about 80 wt % to about 95 wt %, or about 15 wt % to about 40 wt % of the polyether polymer, based on the total weight of the polyether and the hydrophilic polymer. In one or more embodiments, the release aid can include from a low of about 1 wt %, about 5 wt %, about 10 wt %, about 15 wt %, about 20 wt %, about 25 wt %, about 30 wt %, about 35 wt %, about 40 wt %, or about 45 wt % to a high of about 55 wt %, about 60 wt %, about 65 wt %, about 70 wt %, about 75 wt %, about 80 wt %, about 85 wt %, about 90 wt %, about 95 wt %, or about 99 wt % of the hydrophilic, based on the total weight of the polyether and the hydrophilic polymer. For example, the release aid can include about 20 wt % to about 80 wt %, about 30 wt % to about 70 wt %, about 40 wt % to about 80 wt %, about 50 wt % to about 70 wt %, about 60 wt % to about 80 wt %, about 65 wt % to about 75 wt %, about 60 wt % to about 70 wt %, about 70 wt % to about 90 wt %, about 40 wt % to about 60 wt %, about 75 wt % to about 80 wt %, about 80 wt % to about 95 wt %, or about 15 wt % to about 40 wt % of the hydrophilic polymer, based on the total weight of the polyether and the hydrophilic polymer.

In one or more embodiments, the release aid can include the polyether, the hydrophilic polymer, and a liquid medium, e.g., water. The release aid can have a liquid medium, e.g., water, concentration from a low of about 0.1 wt %, about 1 wt %, about 3 wt %, about 5 wt %, about 10 wt %, about 15 wt %, or about 20 wt % to a high of about 50 wt %, about 55 wt %, about 60 wt %, about 65 wt %, about 70 wt %, about 75 wt %, about 80 wt %, about 85 wt %, about 90 wt %, about 95 wt %, about 97 wt %, about 98 wt %, about 99 wt %, or about 99.9 wt %, based on the total weight of the polyether, the hydrophilic polymer, and the liquid medium. For example, the release aid can have a liquid medium, e.g., water, concentration of about 0.1 wt % to about 5 wt %, about 3 wt % to about 12 wt %, about 5 wt % to about 15 wt %, about 8 wt % to about 25 wt %, about 15 wt % to about 30 wt %, about 15 wt % to about 25 wt %, about 25 wt % to about 35 wt %, about 35 wt % to about 55 wt %, about 30 wt % to about 45 wt %, about 35 wt % to about 50 wt %, about 55 wt % to about 70 wt %, about 50 wt % to about 65 wt %, about 70 wt % to about 95 wt %, about 85 wt % to about 98 wt %, about 90 wt % to about 99 wt %, or about 95 wt % to about 98 wt %, based on the total weight of the polyether, the hydrophilic polymer, and the liquid medium.

In one or more embodiments, the release aid can have a liquid medium, e.g., water, concentration from a low of about 0.1 vol %, about 1 vol %, about 3 vol %, about 5 vol %, about 10 vol %, about 15 vol %, or about 20 vol % to a high of about 50 vol %, about 55 vol %, about 60 vol %, about 65 vol %, about 70 vol %, about 75 vol %, about 80 vol %, about 85 vol %, about 90 vol %, about 95 vol %, about 97 vol %, about 98 vol %, about 99 vol %, or about 99.9 vol %, based on the total volume of the polyether, the hydrophilic polymer, and the liquid medium. In one or more embodiments, the combined amount of the polyether and the hydrophilic polymer in the release aid that also includes a liquid medium, e.g., water, can be from a low of about 0.1 vol %, about 0.5 vol %, about 1 vol %, about 2 vol %, about 3 vol %, about 4 vol %, about 5 vol %, about 10 vol %, about 15 vol %, or about 20 vol % to a high of about 50 vol %, about 55 vol %, about 60 vol %, about 65 vol %, about 70 vol %, about 75 vol %, about 80 vol %, about 85 vol %, about 90 vol %, about 95 vol %, about 97 vol %, about 98 vol %, about 99 vol %, or about 99.9 vol %, based on the total volume of the polyether, the hydrophilic polymer, and the liquid medium. For example, the combined amount of the polyether and the hydrophilic polymer in the release aid that also includes a liquid medium, e.g., water, can be about 0.5 vol % to about 20 vol %, about 1 vol % to about 10 vol %, about 1 vol % to about 15 vol %, about 2 vol % to about 4 vol %, about 3 vol % to about 8 vol %, about 5 vol % to about 12 vol %, about 1 vol % to about 20 vol %, or about 1 vol % to about 99 vol %, based on the total volume of the polyether, the hydrophilic polymer, and the liquid medium. In another example, the combined amount of the polyether and the hydrophilic polymer in the release aid that also includes a liquid medium, e.g., water, can be less than 50 vol %, less than 40 vol %, less than 30 vol %, less than 20 vol %, less than 15 vol %, less than 12 vol %, less than 10 vol %, less than 8 vol %, less than 6 vol %, less than 5 vol %, less than 4 vol %, or less than 3 vol %, based on the total volume of the polyether, the hydrophilic polymer, and the liquid medium.

In one or more embodiments, when combined with a liquid medium, e.g., water, the release aid can have a total solids concentration from a low of about 1 wt %, about 3 wt %, about 5 wt %, about 10 wt %, about 15 wt %, about 20 wt %, about 25 wt %, about 30 wt %, about 35 wt %, about 40 wt %, about 45 wt %, about 50 wt %, about 55 wt %, about 60 wt %, or about 65 wt % to a high of about 75 wt %, about 80 wt %, about 85 wt %, about 90 wt %, about 95 wt %, about 97 wt %, about 98 wt %, or about 99 wt %, based on the total weight of the polyether, the hydrophilic polymer, and the water. In another example, the release aid can have a total solids concentration of about 20 wt % to about 50 wt %, about 35 wt % to about 60 wt %, about 45 wt % to about 85 wt %, about 60 wt % to about 90 wt %, about 85 wt % to about 95 wt %, about 93 wt % to about 99 wt %, about 80 wt % to about 90 wt %, or about 96 wt % to about 99 wt %, based on the total weight of the polyether, the hydrophilic polymer, and the water. As used herein, the solids content of the aqueous solution of the release aid, as understood by those skilled in the art, can be measured by determining the weight loss upon heating a small sample, e.g., 1-5 grams of the release aid, to a suitable temperature, e.g., 125° C., and a time sufficient to remove the water therefrom.

In one or more embodiments, the release aid can be mixed, blended, or otherwise combined with one or more adhesives to produce a creping composition. In one or more embodiments, the release aid and/or the creping composition can be applied to the surface of a dryer, e.g., a surface of a Yankee dryer. To allow for adequate formation of interpolymer complexes between the polyether and the hydrophilic polymer in the release aid, the polyether and the hydrophilic polymer can be mixed for a time period from a low of about 5 seconds, about 20 seconds, about 30 seconds, about 45 seconds, about 1 minute, about 1.5 minutes, or about 2 minutes to a high of about 10 minutes, 20 minutes, or about 30 minutes before mixing with an adhesive to produce the creping composition and applying the creping composition to the surface of the dryer. For example, the polyether and the hydrophilic polymer can be mixed for about 5 seconds to about 20 seconds, about 10 seconds to about 1 minute, about 20 seconds to about 2 minutes, about 50 seconds to about 3 minutes, about 2 minutes to about 10 minutes, about 4 minutes to about 8 minutes, about 5 minutes to about 12 minutes, about 10 minutes to about 20 minutes, or about 15 minutes to about 30 minutes, before mixing with the adhesive to produce the creping composition and applying the creping composition to the surface of the dryer. In another example, the polyether and the hydrophilic polymer can be mixed for at least 10 seconds, at least 30 seconds, at least 1 minute, at least 2 minutes, at least 2.5 minutes, at least 3 minutes, at least 3.5 minutes, at least 4 minutes, at least 4.5 minutes or at least 5 minutes to about 10 minutes, about 20 minutes, about 30 minutes or more before mixing with an adhesive to produce the creping composition and applying the creping composition to the surface of the dryer.

The adhesive and release aid can be mixed with one another at any desired ratio to produce the creping composition. For example, a weight ratio of the adhesive to the release aid can be from a high of about 99:1, about 90:10, about 80:20, about 70:30, about 60:40, or about 50:50 to a low of about 40:60, about 30:70, about 20:80, about 10:90, or about 1:99. In another example, the weight ratio of the adhesive to the release aid can be about 99:1 to about 90:10, about 90:1 to about 80:20, about 80:20 to about 70:30, about 70:30 to about 60:40, about 60:40 to about 50:50, about 50:50 to about 40:60, about 40:60 to about 30:70, about 30:70 to about 20:80, about 20:80 to about 10:90, or about 10:90 to about 1:99.

In at least one embodiment, the creping composition can include water. For example, the creping composition can have a water concentration from a low of about 0.1 wt %, about 1 wt %, about 3 wt %, about 5 wt %, about 10 wt %, about 15 wt %, about 20 wt %, about 30 wt %, or about 40 wt % to a high of about 50 wt %, about 55 wt %, about 60 wt %, about 65 wt %, about 70 wt %, about 75 wt %, about 80 wt %, about 85 wt %, about 90 wt %, about 95 wt %, or about 99 wt %, based on the total weight of the polyether, the hydrophilic polymer, the adhesive, and the water. In another example, the creping composition can have a water concentration of about 0.1 wt % to about 5 wt %, about 3 wt % to about 12 wt %, about 5 wt % to about 15 wt %, about 8 wt % to about 25 wt %, about 15 wt % to about 30 wt %, about 15 wt % to about 25 wt %, about 25 wt % to about 35 wt %, about 35 wt % to about 55 wt %, about 30 wt % to about 45 wt %, about 35 wt % to about 50 wt %, about 55 wt % to about 70 wt %, about 50 wt % to about 65 wt %, about 70 wt % to about 85 wt %, about 80 wt % to about 95 wt %, or about 90 wt % to about 99 wt %, based on the total weight of the polyether, the hydrophilic polymer, the adhesive, and the water.

The creping composition can have a total solids concentration from a low of about 1 wt %, about 5 wt %, about 10 wt %, about 15 wt %, about 20 wt %, about 25 wt %, about 30 wt %, about 35 wt %, about 40 wt %, about 45 wt %, about 50 wt %, about 55 wt %, about 60 wt %, or about 65 wt % to a high of about 75 wt %, about 80 wt %, about 85 wt %, about 90 wt %, about 95 wt %, about 97 wt %, or about 99 wt %, based on the total weight of the polyether, the hydrophilic polymer, the adhesive, and the water. In another example, the creping composition can have a total solids concentration of about 20 wt % to about 50 wt %, about 35 wt % to about 60 wt %, about 45 wt % to about 85 wt %, or about 60 wt % to about 90 wt %, based on the total weight of the polyether, the hydrophilic polymer, the adhesive, and the water.

Suitable hydrophilic polymers can include, but are not limited to, one or more polyvinyl alcohols, one or more starches, one or more tannins, one or more lignins, one or more novolac resins, one or more polyacrylic acids, carboxymethyl cellulose, one or more copolymers that include acrylic acid, one or more copolymers that include methacrylic acid, one or more copolymers that include itaconic acid, one or more copolymers that include maleic anhydride, or any mixture thereof.

Starch is a carbohydrate made up of a large number of glucose units joined by glycosidic bonds. Suitable starches can include, but are not limited to, those obtained from maize or corn, such as waxy maize and high amylose maize; potato; tapioca; wheat; or any mixture thereof. In one or more embodiments, suitable starches can include those discussed and described in *Wood and Cellulosic Chemistry*, Revised and Expanded Second Edition, edited by David Hon and Nobue Shiraishi, Marcel Dekker, Inc., 2000.

Carboxymethyl cellulose ("CMC") is a cellulose derivative with some of the hydroxyl groups of the glucopyranose monomers replaced with carboxymethyl groups (—$CH_2CO_2H$) that make up the cellulose backbone. Carboxymethyl cellulose can be represented by the general Formula I:

(Formula I)

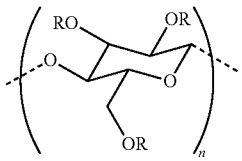

where each R can independently be H or $CH_2CO_2H$ and n can be an integer of 2 to about 10,000. Carboxymethyl cellulose can be used as a salt, such as sodium carboxymethyl cellulose. Carboxymethyl cellulose can be synthesized by an alkali-catalyzed reaction of cellulose with chloroacetic acid. The hydrophilic properties of carboxymethyl cellulose can depend, at least in part, on the degree of substitution of the cellulose structure (i.e., how many of the hydroxyl groups have taken part in the substitution reaction), as well as the chain length of the cellulose backbone structure and the degree of clustering of the carboxymethyl substituents.

Suitable novolac resins can be produced by reacting a phenol component or phenolic compound(s) with an aldehyde component or aldehyde compound(s) in the presence of a catalyst. The phenol component of the novolac resin can include a variety of substituted phenolic compounds, unsubstituted phenolic compounds, or any combination of substituted and/or unsubstituted phenolic compounds. For example, the phenol component can be phenol itself, i.e., mono-hydroxy benzene. Examples of substituted phenols can include, but are not limited to, alkyl-substituted phenols, such as the cresols and xylenols; cycloalkyl-substituted phenols, such as cyclohexyl phenol; alkenyl-substituted phenols; aryl-substituted phenols, such as p-phenyl phenol; alkoxy-substituted phenols, such as 3,5-dimethyoxyphenol; aryloxy phenols, such as p-phenoxy phenol; and halogen-substituted phenols, such as p-chlorophenol. Dihydric phenols, such as catechol, resorcinol, hydroquinone, bis-phenol A and bis-phenol F can also be used. Specific examples of suitable phenolic compounds (phenol components) for replacing a portion or all of the phenol used in preparing a novolac resin can include, but are not limited to, bis-phenol A, bis-phenol F, o-cresol, m-cresol, p-cresol, 3,5-xylenol, 3,4-xylenol, 3,4,5-trimethylphenol, 3-ethyl phenol, 3,5-diethyl phenol, p-butyl phenol, 3,5-dibutyl phenol, p-amyl phenol, p-cyclohexyl phenol, p-octyl phenol, 3,5-dicyclohexyl phenol, p-phenyl phenol, p-phenol, 3,5-dimethoxy phenol, 3,4,5-trimethoxy phenol, p-ethoxy phenol, p-butoxy phenol, 3-methyl-4-methoxy phenol, p-phenoxy phenol, naphthol, anthranol and substituted derivatives thereof.

Illustrative aldehyde compounds can include the so-called masked aldehydes or aldehyde equivalents, such as acetals or hemiacetals. Suitable aldehydes can be represented by the general formula RCHO, where R is a hydrogen or an alkyl having 1-8 carbons. Specific examples of suitable aldehyde compounds can include, but are not limited to, formaldehyde, acetaldehyde, propionaldehyde, butyraldehyde, furfuraldehyde, benzaldehyde, or any mixture thereof. As used herein, the term "formaldehyde" can refer to formaldehyde, formaldehyde derivatives, or combinations thereof. Preferably, the aldehyde component is formaldehyde. One or more difunctional aldehydes can also be used to produce the novolac resin, and could advantageously be used to introduce cross-links ultimately into the at least partially cured novolac resin.

The aldehyde component can be used in many forms such as solid, liquid, and/or gas. Considering formaldehyde in particular, the formaldehyde can be or include paraform (solid, polymerized formaldehyde), formalin solutions (aqueous solutions of formaldehyde, sometimes with methanol, in 37 percent, 44 percent, or 50 percent formaldehyde concentrations), urea-formaldehyde concentrate ("UFC"), and/or formaldehyde gas in lieu of or in addition to other forms of formaldehyde can also be used. In another example, the aldehyde can be or include a pre-reacted urea-formaldehyde mixture having a urea to formaldehyde weight ratio of about 1:2 to about 1:3.

A molar ratio of aldehyde component to phenol component used to produce the novolac resin can be from a low of about 0.5, about 0.6, or about 0.7 to a high of about 0.85, about 0.9, or about 0.95. For example, the molar ratio of the aldehyde component to the phenol component used to produce the novolac resin can be from about 0.5 to about 0.6, about 0.6 to about 0.7, about 0.7 to about 0.8, about 0.8 to about 0.9, or about 0.85 to about 0.95.

The reaction between the phenol component and the aldehyde component to produce the novolac resin can be carried out in the presence of an acid catalyst under acidic conditions. Suitable acid catalysts can include, but are not limited to, oxalic acid, sulfuric acid, p-toluene sulfuric acid, hydrochloric acid, salicylic acid, mineral acids and salts thereof, or any mixture thereof. Mixed catalyst systems, such as ZnOAc/oxalic acid and other divalent metal compounds, e.g., acetates, can be used to prepare "high-ortho" novolac resins. Divalent metal compounds can include Ca, Mg, Zn, Cd, Pb, Cu, Co, and Ni. Preferred catalysts can include oxalic acid, sulfuric acid, p-toluene sulfonic acid, and ZnOAc/oxalic acid.

The amount of catalyst used to produce the novolac resin can be sufficient to catalyze the reaction between the phenol component and the aldehyde component to produce the novolac resin. The reaction can be conducted in about 1 hour to about 6 hours, e.g., in about 2 hours to about 4 hours. The phenol-formaldehyde reaction can be carried out at a temperature from about 80° C. to about 100° C. The reaction can be carried out at atmospheric pressure, although increased pressure can be utilized to permit the application of higher temperatures and, therefore, faster reaction rates and accordingly shorter reaction times.

The novolac resin can be treated to remove water and/or other volatile organic materials by heating, such as by distillation. After this treatment, the free phenol can be about 0.001 wt % to about 2 wt %. Distillation of the resulting novolac resin can be performed at atmospheric pressure by heating up to about 140° C., and then under a vacuum until the resin reaches a temperature of about 180° C. to about 220° C. Other suitable methods for treating the resin via heat can include thin-film evaporators. The resulting molten novolac resin can be cooled to a temperature below about 100° C.

If desired, the novolac resin can be neutralized. Neutralization of the novolac resin can be accomplished by the addition of one or more bases or base compounds, such as sodium hydroxide or potassium hydroxide. The base compound can be added in an amount sufficient to raise the pH of the novolac resin to be about 5 to about 9. The base compound can be added in an amount of about 10 wt % to about 30 wt % of water, based on the total resin solids, can be added. Suitable novolac resins can include those discussed and described in U.S. Pat. No. 5,670,571 and U.S. Patent Application Publication No. 2008/0280787.

In one or more embodiments, the novolac resin can have a weight average molecular weight ($M_w$) from a low of about 450, about 550, about 750 to about 2,500, about 3,000, or about 3,500. For example, the weight average molecular weight of novolac resin can be about 450 to about 550, about 550 to about 750, about 750 to about 1,550, about 1,450 to about 2,550, about 2,450 to about 3,500. As known by those skilled in the art, the molecular weights, e.g., weight average molecular weight, number average molecular weight, and z-average molecular weight, can be determined using Gel Permeation Chromatography (GPC). This technique utilizes an instrument containing columns packed with porous beads, an elution solvent, and detector in order to separate polymer molecules of different sizes, and is well known to those skilled in the art. The molecular weight, e.g., weight average molecular weight and/or number average molecular weight of the resins, lignin, copolymers, block copolymers, polyethers, pre-polymers, reactive modifiers, and other materials discussed and described herein can be determined using GPC.

Tannins are bitter plant polyphenolic compounds capable of forming complexes with various macromolecules, such as proteins. As used herein, the term "tannin" refers to both hydrolyzable tannins and condensed tannins. Illustrative genera of shrubs and/or trees from which suitable tannins can be derived can include, but are not limited to, *Acacia, Castanea, Vachellia, Senegalia, Terminalia, Phyllanthus, Caesalpinia, Quercus, Schinopsis, Tsuga, Rhus, Juglans, Carya*, and *Pinus*, or any mixture thereof. In another example, genera from which suitable tannins can be derived can include, but are not limited to, *Schinopsis, Acacia*, or mixtures thereof. In another example, genera from which suitable tannins can be derived can include, but are not limited to, *Pinus, Carya*, or a mixture thereof.

Hydrolyzable tannins are mixtures of simple phenols such as pyrogallol and ellagic acid and of esters of a sugar, e.g., glucose, with gallic and digallic acids. Illustrative hydrolyzable tannins can include, but are not limited to, extracts recovered from *Castanea sativa*, (e.g., chestnut), *Terminalia* and *Phyllantus* (e.g., myrabalans tree species), *Caesalpinia coriaria* (e.g., divi-divi), *Caesalpinia spinosa*, (e.g., tara), algarobilla, valonea, and *Quercus* (e.g., oak). Condensed tannins are polymers formed by the condensation of flavans. Condensed tannins can be linear or branched molecules. Illustrative condensed tannins can include, but are not limited to, *Acacia mearnsii* (e.g., wattle or mimosa bark extract), *Schinopsis* (e.g., quebracho wood extract), *Tsuga* (e.g., hemlock bark extract), *Rhus* (e.g., sumach extract), *Juglans* (e.g., walnut), *Carya illinoinensis* (e.g., pecan), and *Pinus* (e.g., Radiata pine, Maritime pine, bark extract species).

The condensed tannins can include about 70 wt % to about 80 wt % active phenolic ingredients (the "tannin fraction") and the remaining ingredients (the "non-tannin fraction") can include, but are not limited to, carbohydrates, hydrocolloid gums, amino and/or imino acid fractions, or any mixture thereof. The condensed tannins can be used as recovered or extracted from the organic matter or the condensed tannins can be purified, e.g., about 95 wt % or more active phenolic ingredients. Hydrolyzable tannins and condensed tannins can be extracted from the starting material, e.g., trees and/or shrubs, using well established processes. A more detailed discussion of tannins is discussed and described in the *Handbook of Adhesive Technology,* Second Edition, CRC Press, 2003, chapter 27, "Natural Phenolic Adhesives I: Tannin"; *Monomers, Polymers and Composites from Renewable Resources*, Elsevier, 2008, chapter 8, "Tannins: Major Sources, Properties and Applications"; *Plant Polyphenols: Synthesis, Properties, Significance*, edited by Richard W. Hemingway and Peter E. Laks, Plenum Press, 1992; Wilfred Vermerris & Ralph Nicholson, *Phenolic Compound Biochemistry*, Springer (2006).

The condensed tannins can be classified or grouped into one of two main categories, namely, those containing a resorcinol unit and those containing a phloroglucinol unit. Illustrative tannins that include the resorcinol unit include, but are not limited to, black wattle tannins and quebracho tannins. The resorcinol unit can be represented by Structure I below.

(Structure I)

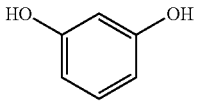

The resorcinol group is shown within the box overlaying the unit structure of black wattle and quebracho tannins in Structure II below. For simplicity, the structure of black wattle and quebracho tannins is represented by the flavonoid unit shown in Structure II.

(Structure II)

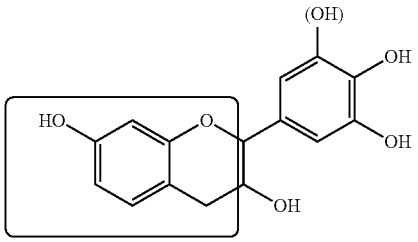

Illustrative tannins that include the phloroglucinol unit include, but are not limited to, pecan tannins and pine tannins. The phloroglucinol unit can be represented by Structure III below.

(Structure III)

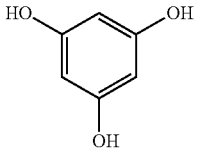

The phloroglucinol unit is shown within the box overlaying the unit structure of pecan and pine tannins in Structure IV below. For simplicity, the structure of pecan and pine tannins is represented by their flavonoid unit structure.

(Structure IV)

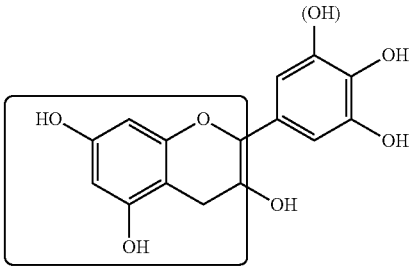

Phloroglucinol is known for higher reactivity than resorcinol. As such, tannins that include the phloroglucinol unit are more reactive than tannins that include the resorcinol unit.

If the release aid includes a mixture of hydrolyzable tannins and condensed tannins any ratio with respect to one another can be used. For example, a release aid that includes both hydrolyzable tannins and condensed tannins can have a concentration of condensed tannins from about 1 wt % to about 99 wt %, based on the total weight of the hydrolyzable tannins and the condensed tannins. In another example, a release aid that includes both hydrolyzable tannins and condensed tannins can have a concentration of condensed tannins of about 50 wt % or more, about 55 wt % or more, about 60 wt % or more, about 70 wt % or more, about 75 wt % or more, about 80 wt % or more, about 85 wt % or more, about 90 wt % or more, about 95 wt % or more, or about 97 wt %, based on the total weight of the hydrolyzable tannins and the condensed tannins.

The tannins can have an acidic pH in water. For example, the pH of the tannins in water can be from a low of about 3, about 3.5, or about 4 to a high of about 5, about 5.5, about 6, or about 6.5. The tannins can have resorcinol and/or phloroglucinol functional groups. Suitable, commercially available tannins can include, but are not limited to, black wattle tannins, quebracho tannins, hemlock tannins, sumach tannins, pecan tannins, mimosa tannins, pine tannins, or any mixture thereof.

Lignin is a polymeric substance that can include substituted aromatics found in wood, plant, and/or vegetable matter associated with cellulose and other plant constituents. Illustrative plant and vegetable matter can include, but is not limited to, straw, hemp, sisal, cotton stalk, wheat, bamboo, sabai grass, rice straw, banana leaves, paper mulberry (i.e., bast fiber), abaca leaves, pineapple leaves, esparto grass leaves, fibers from the genus Hesperaloe in the family Agavaceae jute, salt water reeds, palm fronds, flax, ground nut shells, hardwoods, softwoods, recycled fiberboards such as high density fiberboard, medium density fiberboard, low density fiberboard, oriented strand board, particleboard, or any mixture thereof. For example, the plant matter can be or include wood, for example hardwoods, softwoods, or mixtures thereof. Illustrative types of wood can include, but are not limited to, alder, ash, aspen, basswood, beech, birch, cedar, cherry, cottonwood, cypress, elm, fir, gum, hackberry, hickory, maple, oak, pecan, pine, poplar, redwood, sassafras, spruce, sycamore, walnut, canow, or any mixture thereof.

The lignin can be extracted, separated, or otherwise recovered from the wood, plant, and/or vegetable matter using any of a number of well-established processes. For example, in the pulp and paper industry, lignin-containing materials such as wood, straw, corn stalks, bagasse, and other vegetable and plant tissues can be processed to recover the cellulose or pulp via the well-known kraft or sulfate process or the well-known sulfite process. The residual pulping liquors that include the lignin as a by-product can be a source of lignin. The chemical structure of lignin can vary and the variation can depend, at least in part, on the particular plant from which the lignin is recovered from, location the plant was grown, and/or on the particular method used in recovery or isolation of the lignin from the plant and/or vegetable matter. Lignin can include active groups, such as active hydrogens and/or phenolic hydroxyl groups through which crosslinking or bridging can be effected.

One process for recovering lignin can be or include the process commonly referred to as the organosolve process. The organosolve process uses an organic solvent to solubilize lignin and hemicelluloses. The organosolve process can include contacting lignocellulose material, e.g., wood chips or particles, with an aqueous organic solvent at a temperature from a low of about 130° C., about 140° C., or about 150° C. to a high of about 200° C., about 220° C., or about 230° C. The lignin can break down by hydrolytic cleavage of alpha aryl-ether links into fragments that can be solubilized in the solvent system. Illustrative solvents can include, but are not limited to, acetone, methanol, ethanol, butanol, ethylene glycol, formic acid, acetic acid, or any mixture thereof. The aqueous organic solvent can have a concentration of the solvent in water from a low of about 30 wt %, about 40 wt % or about 50 wt % to a high of about 70 wt %, about 80 wt %, or about 90 wt %.

Since the lignin separated from the plant can be chemically altered from that found in the plant, the term "lignin," can also refer to lignin products obtained upon separation from the cellulose or recovered from the plant matter. For example, in a sulfite pulping process, the lignocellulose material can be digested with a bisulfite or sulfite resulting in the at least partial sulfonation of the lignin. As such, the lignin can optionally be subjected to further cleavage and/or other modifications such as alkaline treatment or reaction with other constituents to decrease the sulfonate or sulfur content and/or increase the active groups. For example, the lignin can be processed such that it has a phenolic hydroxyl content from about 1.5 wt % to about 5 wt % and less than about 3 wt % sulfonate sulfur. In other methods of recovery or separation of lignin from wood, plant, or vegetable material, the lignin may not be sulfonated, but could be chemically altered somewhat in some other manner. For example, in residual pulping liquors obtained in sulfate or other alkaline pulping processes, the lignin can be present as an alkali metal salt dissolved in the alkaline, aqueous liquor and can generally include a sufficient phenolic hydroxyl content to require no further modification. However, the alkali or kraft lignin can be further reacted with other constituents to further increase the active groups. "Hydrolysis lignin" that can be recovered from the hydrolysis of lignocellulose materials in the manufacture of sugar, for example, can also be altered somewhat from that found in the plant. As such hydrolysis lignin can be further modified to solubilize the lignin as well as to increase the phenolic hydroxyl content. Also, the lignin products such as residual pulping liquor may be subjected to various treatments such as, for example, acid, alkaline or heat treatments or reacted with the other chemicals which may further alter somewhat the lignin constituents.

The residual pulping liquors or the lignin products produced in the separation or recovery of lignin from the plant matter can include lignin having a weight average molecular weights of about 300 to greater than 100,000. For example, the lignin can have a weight average molecular weight from a low of about 500, about 1,000, about 5,000, about 10,000, about 15,000, or about 20,000 to a high of about 30,000, about 45,000, about 55,000, about 70,000, about 80,000, about 85,000, about 90,000, or about 95,000. In another example, the lignin can have a weight average molecular weight from a low of about 300, about 500, about 800, about 900, about 1,000, or about 1,100 to a high of about 1,300, about 1,500, about 1,900, about 2,300, about 2,500, about 2,700, about 3,000, about 3,300, about 3,500, about 3,700, about 4,000, about 4,300, about 4,500, about 4,700, or about 5,000. In another example, the lignin can have a weight average molecular weight from a about 500 to about 30,000, about 1,000 to about 15,000, about 800 to about 6,000, about 2,000 to about 12,000, about 400 to about 10,000, or about 600 to about 8,000. In another example, the weight average molecular weight of the lignin can be from about 600 to about 4,500, about 350 to about 1,100, about 750 to about 2,500, about 950 to about 3,100, about 1,500 to about 3,400, or about 1,800 to about 4,200.

The liquors from which the lignin can be recovered can also include one or more other constituents in addition to the lignin. For example, in the sulfite pulping process, the spent sulfite liquor can include lignosulfonates that can be present as salts of cations, such as magnesium, calcium, ammonium, sodium and/or other cations. The spent sulfite liquor solids can include about 40 wt % to about 65 wt % lignosulfonates with the remainder being carbohydrates and other organic and inorganic constituents dissolved in the liquor. Lignin products produced by other pulping processes can also include other materials such as carbohydrates, degradation products of carbohydrates, and resinous materials which are separated from the cellulosic materials with the lignin. It should be noted that it is not necessary to separate the lignin from the other constituents that can be present.

Suitable lignin material can include, but is not limited to, lignin in its native or natural state, i.e., non-modified or unaltered lignin, lignosulfonates, or any combination or mixture thereof. Suitable lignosulfonates can include, but are not limited to, ammonium lignosulfonate, sodium lignosulfonate, calcium lignosulfonate, magnesium lignosulfonate, or any combination or mixture thereof. Commercially available lignin can include lignosulfonates available from Tembec (Canada).

Suitable processes for isolating or otherwise separating lignin or lignin containing products form wood, plant, vegetable, or other lignin containing matter can include those discussed and described in U.S. Pat. Nos. 1,856,567; 2,525,433; 2,680,113; 2,690,973; 3,094,515; 3,158,520; 3,503,762; 3,585,104; 3,726,850; 3,769,272; 3,841,887; 4,100,016; 4,131,564; 4,184,845; 4,308,203; 4,355,996; 4,470,876; 4,740,591; and 4,764,596; U.S. Patent Application Publication Nos.: 2011/0294991; and WO Publication Nos. WO1992/018557A1, WO1993/021260A2; WO1994/024192A1; WO2005/062800A2; WO2006/031175 A1; and WO2011/150508. A more detailed discussion of lignin is discussed and described in *Plant Polyphenols: Synthesis, Properties, Significance*, edited by Richard W. Hemingway and Peter E. Laks, Plenum Press, 1992.

Monomers capable of polymerizing with maleic anhydride to form suitable copolymers can include, but are not limited to, olefins, such as ethylene, propylene, 1-butene, 1-hexene, 1-octene, isobutene, diisobutylene, limonene, cyclohexene, norbornene, 1,4-butadiene, isoprene, and 1-octadecene; vinyl esters, such as vinyl acetate, vinyl pivalate, vinyl propionate, and isopropenyl acetate; vinyl halides, such as vinyl chloride and vinylidene chloride; aromatic vinyl compounds, such as vinyl naphthalene, styrene, vinyl pyridine, divinylbenzene, and vinyl pyrrolidone; vinyl amide, such as vinyl acetamide; vinyl ethers, such as vinyl methyl ether, vinyl ethyl ether, and vinyl isobutyl ether; and other vinyl compounds, such as vinyl methyl ketone, divinyl ketone, and vinyl ethyl sulphone; allyl compounds, such as esters and ethers of allyl alcohol; acrolein, and its acetals or anhydrides; acrylates, such as ethylene glycol diacrylate, butanediol dimethacrylate, methyl methacrylate, ethyl methacrylate, methyl acrylate, ethyl acrylate, butyl acrylate, and dimethacrylate; esters of itaconic acid, fumaric acid, and maleic acid, including imides and amides of these acids, such as maleic imide, N-cyclohexylmaleic imide, N-phenyl maleic imide, and N-methyl maleic imide; or any mixture thereof.

The weight average molecular weight of the copolymer made from monomers that include maleic anhydride can widely vary. For example, the weight average molecular weight of the copolymer of maleic anhydride can be from a low of about 450, about 550, or about 750 to a high of about 2,500, about 3,000, or about 3,500. In another example, the weight average molecular weight of copolymer of maleic anhydride can be about 450 to about 550, about 550 to about 750, about 750 to about 1,550, about 1,450 to about 2,550, or about 2,450 to about 3,500.

Monomers capable of polymerizing with itaconic acid to form suitable copolymers can include, but are not limited to, aromatic vinyl compounds, such as styrene, α-methylstyrene, o-chlorostyrene, and vinyl-toluenes; vinyl esters of aliphatic $C_1$-$C_{18}$, such as vinyl acetate, vinyl propionate, vinyl butyrate, vinyl valerate, vinyl hexanoate, vinyl 2-ethylhexanoate, vinyl decanoate, vinyl pivalate, vinyl laurate, and vinyl stearate; esters of ethylenically unsaturated $C_3$-$C_8$ mono- or dicarboxylic acids with $C_1$-$C_8$-alkanols or $C_5$-$C_8$-cycloalkanols, such as methyl, ethyl, isopropyl, n-butyl, isobutyl, 1-hexyl, tert-butyl and 2-ethylhexyl acrylates and methacrylates, dimethyl fumarate, dimethyl maleate, and di-n-butyl maleate; nitriles of α,β-monoethylenically unsaturated $C_3$-$C_8$-carboxylic acids, acrylonitrile and methacrylonitrile; and $C_4$-$C_8$ conjugated dienes, such as 1,3-butadiene, isoprene or chloroprene α-olefins, such as ethylene, propene, and isobutene; or any mixture thereof. Example of unsaturated $C_3$-$C_8$ mono- or dicarboxylic acids can include, but are not limited to, acrylic acid, methacrylic acid, crotonic acid, maleic acid, citraconic acid, and fumaric acid. Examples of suitable $C_1$-$C_{18}$-alkanols can include, but are not limited to, methanol, ethanol, n-propanol, i-propanol, 1-butanol, 2-butanol, isobutanol, tert-butanol, n-hexanol, 2-ethylhexanol, lauryl alcohol, and stearyl alcohol. Examples of suitable $C_5$-$C_8$-cycloalkanols can include, but are not limited to, cyclopentanol and cyclohexanol.

The weight average molecular weight of the copolymer made from monomers that include itaconic acid can widely vary. The weight average molecular weight of the copolymer of itaconic acid be from a low of about 450, about 550, or about 750 to a high of about 2,500, about 3,000, or about 3,500. For example, the weight average molecular weight of the copolymer of itaconic acid can be about 450 to about 550, about 550 to about 750, about 750 to about 1,550, about 1,450 to about 2,550, or about 2,450 to about 3,500.

The polyether can include, but is not limited to, polypropylene glycol (PPG), polyethylene glycol (PEG), one or more copolymers of propylene glycol and ethylene glycol (co-PPG-PEG), one or more blends of polypropylene glycol (PPG) and polyethylene glycol (PEG), one or more alcohol ethoxylates (AEOs), one or more alcohol propoxylates (APOs), and one or more alkylphenol ethoxylates (APEOs), or any mixture thereof. The copolymer of propylene glycol and ethylene glycol can be a block copolymer. It should be noted that the polyethyelne glycol can also be referred to as a polethylene oxide (PEO) or polyoxyethylene (POE). In at least one specific embodiment, the polyether can be or include a polyethylene oxide (PEO) polymer. In at least one specific embodiment, the polyether can be or include a block-copolymer of ethylene oxide and propylene oxide (EO-PO-EO).

A range of different molecular weights and block copolymers of propylene glycol and ethylene glycol can be used. The weight average molecular weight of the polypropylene glycol can be from a low of about 450, about 550, or about 750 to a high of about 2,500, about 3,000, or about 3,500. For example, the weight average molecular weight of polypropylene glycol can be about 450 to about 550, about 550 to about 750, about 750 to about 1,550, about 1,450 to about 2,550, or about 2,450 to about 3,500. The weight average molecular weights of block copolymers of propylene glycol and ethylene glycol can be from a low of about 1,000, about 1,500, or about 2,000 to a high of about 3,000, about 3,500, or about 4,000. For example, the weight average molecular weights of block copolymers of propylene glycol and ethylene glycol can be about 1,000 to about 1,500, about 1,500 to about 2,000, about 2,000 to about 2,500, about 2,500 to about 3,000, about 3,000 to about 3,500, or about 3,500 to about 4,000. The mole percentage of propylene glycol and ethylene glycol can from about 1:1 to about 1:5. The block copolymers of propylene glycol and ethylene glycol can have a ratio of polypropylene glycol monomer residues to polyethylene glyocol monomer residues of about 20:1 to about 1:5.

In at least one specific embodiment, the polyether can be a polypropylene glycol (PPG) having a weight average molecular weight from about 400 to about 3,500. In another example, the polyether component can be a block copolymer of propylene glycol and ethylene glycol having a weight average molecular weight from about 300 to about 4,000, and a ratio of polypropylene glycol monomer residues to polyethylene glyocol monomer residues of about 20:1 to about 1:5.

Alcohol ethoxylates can be represented by the general chemical Formula II:

$$CH_3(CH_2)_mO(CH_2CH_2O)_nH \qquad \text{(Formula II)}$$

where m and n can independently be an integer selected from 1 to about 1,500. For example, m and n can independently be an integer selected from a low of 1, 2, or 3 to a high of about 1,000, about 1,250, or about 1,500. In another example, m and n can independently be an integer selected from 1 to about 50, 2 to about 40, 3 to about 25, 1 to about 1,000, about 200 to about 800, or about 500 to about 1,500.

Alcohol propoxylates can be represented by the general chemical Formula III:

$$CH_3(CH_2)_pO(CH_2\overset{\overset{\displaystyle CH_3}{|}}{C}HO)_qH \qquad \text{(Formula III)}$$

where p and q can independently be an integer selected from 1 to about 1,500. For example, p and q can independently be an integer selected from a low of 1, 2, or 3 to a high of about 1,000, about 1,250, or about 1,500. In another example, p and q can independently be an integer selected from 1 to about 50, 2 to about 40, 3 to about 25, 1 to about 1,000, about 200 to about 800, or about 500 to about 1,500.

Alkylphenol ethoxylates can be represented by the general Formula IV:

(Formula IV)

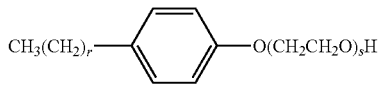

where r and s can independently be an integer selected from 1 to about 1,500. For example, r and s can independently be an integer selected from a low of 1, 2, or 3 to a high of about 1,000, about 1,250, or about 1,500. In another example, r and s can independently be an integer selected from 1 to about 50, 2 to about 40, 3 to about 25, 1 to about 1,000, about 200 to about 800, or about 500 to about 1,500.

The synthesis of the alkylphenol ethoxylates can be based on a phenol, which can be alkylated, followed by ethoxylation using KOH/ethanol as a catalyst with a known ratio of ethylene oxide to the alkylphenol. A similar process is used for the formation of alcohol polyethers starting with fatty alcohols. Production of alcohol polyethers can be performed by reaction of ethylene oxide or propylene oxide with the fatty alcohols, in which either acidic or basic catalysts can be used for polyether formation. Moreover, if water is present during the synthesis, polyethylene or polypropylene glycols (PEGs or PPGs) can also be produced.

The release aids can further include other conventional release aids. Conventional release aids can include, but are not limited to, non-polar, neutral, and non-water soluble release aid compounds; cationic release aids that can be water-soluble or water insoluble materials; and the like. Any number of cationic and non-ionic release aids can be used in the release aids. For example, release aids can include imidazolines.

The imidazolines that can be used to make the release aids can include quaternary imidazolines. Quaternary imidazolines have a positive charge on the imidazoline moiety that does not rely on protonation of the imidazoline and therefore is unaffected by pH changes. The release aid can include a methyl sulfate or ethyl sulfate salt of a quaternary imidazolines derived from a fatty acid. Suitable methyl sulfate or ethyl sulfate salt of a fatty quaternary imidazolines can be represented by the general Formula V:

(Formula V)

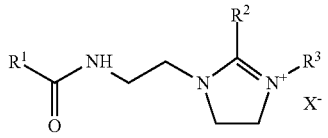

where $R^1$ and $R^2$ can independently be a $(C_6\text{-}C_{22})$alkyl, $R^3$ can be a methyl or an ethyl, and X can be the counter ion $[SO_4]^-$.

The quaternary imidazoline release aids can include hydroxyalkyl imidazolines. The hydroxyalkyl imidazolines can include hydroxyethyl imidazolines that can be represented by the general Formula VI:

(Formula VI)

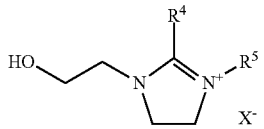

where $R^4$ can be a $(C_6\text{-}C_{22})$alkyl, $R^5$ can be a methyl or an ethyl, and X can be the counter ion $[SO_4]^-$.

The quaternary imidazoline release aids can include aminoalkyl imidazolines, which can be represented by the general Formula VII:

(Formula VII)

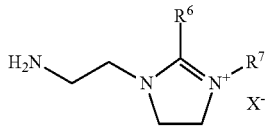

where $R^6$ can be a $(C_6\text{-}C_{22})$alkyl, $R^7$ can be a methyl or an ethyl, and X can be the counter ion $[SO_4]^-$.

Suitable imidazolines can include amidoethyl imidazolines, which can be represented by the general Formula VIII:

(Formula VIII)

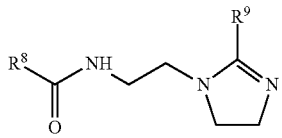

where $R^8$ and $R^9$ can independently be a $(C_6\text{-}C_{22})$alkyl.

Suitable imidazolines can also include hydroxyethyl imidazolines, which can be represented by the general Formula IX:

(Formula IX)

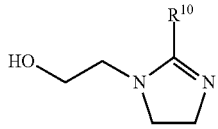

where $R^6$ can be a $(C_6\text{-}C_{22})$alkyl.

Additional examples of particular imidazolines, the synthesis thereof, and properties thereof are provided in D. Bajpai and V. K. Tyagi, Journal of Oleo Science, 2006, 55(7), 319-329. This reference illustrates known methods by which these fatty imidazoline compounds can be prepared and demonstrate the selection of precursors for designing and preparing any particular species of desired imidazoline compound.

Release aids can be supplied as a mixture containing about 90 wt % of release aid and about 10 wt % of diethylene glycol, which then can be dissolved in a high boiling point solvent if desired. For example, a release aid and solvent mixture can include about 20 wt % to about 80 wt % of the imidazoline and about 80 wt % to about 20 wt % of the solvent. For example, the solvent can be a mixture glycols and polyethylene glycols and other solvent components. In one example, a suitable solvent can include a mixture of: polyethylene glycol, having a weight average molecular weight of about 200 to about 600

(20 wt % to 40 wt % of the solvent); polyethylene glycol monooleate (with 9 units of ethylene oxide) (about 10 wt % to about 40 wt % of the solvent); optionally propylene glycol (up to about 20 wt % of the solvent); optionally triethanolamine (up to about 15 wt % of the solvent); and optionally diamidoamine (up to about 7 wt % of the solvent). Alternatively, the surfactant choice for the release aid can also be a mixture of PEG 400 dioleate, PEG 600 dioleate, mineral oil and/or vegetable oil. Additionally, other secondary amines, such as diethanolamine and monoethanolamine, can be included.

In other embodiments, the conventional release aid can also be used in conjunction with oil-based release aids to permit further flexibility in controlling the creping process. For example, conventional release aids can include, but are not limited to, a mineral oil, a vegetable oil, paraffinic oil, a naphthenic oil, or a mixture thereof. Also if desired, the release aids can further include surfactant, emulsifying agents, and anti-foaming.

Suitable adhesives can include, but are not limited to, one or more polyamine-epihalohydrin (PAE) resins, one or more acrylonitrile-grafted copolymers onto cellulose, one or more polyvinyl alcohols, one or more aromatic polyamidoamines, one or more polyvinyl amines, one or more glyoxalated polyacrylamides, one or more polyamines, one or more copolymers of styrene-methacrylic acid, or any mixture thereof. The adhesive for the creping composition can be the same or different than the polyether or the hydrophilic polymer of the release aid.

Polyamine-epihalohydrin resins are the reaction product of an epihalohydrin, preferably epichlorohydrin, and a polyamine resin, including, polyalkylene polyamine resins and polyamidoamine (PAA) resins. The polyalkylene polyamines include, for example, diethylenetriamine and dihexamethylenetriamine. Examples of polyalkylene polyamine-epihalohydrin resins can include those discussed and described in U.S. Pat. Nos. 2,595,935; 3,248,353; and 3,655,506. These PAA resins can be made from a polyalkylene polyamine having at least one secondary amine group and a saturated aliphatic dicarboxylic acid or dicarboxylic acid derivative. The epihalohydrin can include epichlorohydrin, epibromohydrin, and epiiodohydrin, or any mixture thereof.

Examples of processes for making suitable polyamidoamine-epihalohydrin resins can include those discussed and described in U.S. Pat. No. 5,338,807 and Canadian Patent No. 979,579. These polyamine-epihalohydrin resins can be water-soluble and crosslinkable. According to an aspect, the polyamidoamine-epihalohydrin polymer composition can include a reactive, lightly crosslinked polyamidoamine-epihalohydrin polymer and at least 0.1% of covalent halogen by weight of polymer solids. Other methods for making polyamidoamine-epihalohydrin resins can also include those discussed and described, for example, in U.S. Pat. Nos. 2,926,116; 3,058,873; and 3,772,076.

Lightly crosslinked PAEs for use in a creping composition can include polymers prepared by reacting a prepolymer of a diacid, or an ester of a diacid, and a polyamide containing secondary or tertiary amine groups with an epihalohydrin. The epihalohydrin can be epichlorohydrin, for example. The polyamide-amine groups are usually secondary amine groups derived from a polyalkylene polyamine, for example, polyethylene polyamines, polypropylene polyamines or polybutylene polyamines and the like. For example, the polyalkylene polyamine can be diethylene triamine, methyl bis(3-aminopropyl)-amine, triethylene tetramine, tetraethylene pentamine, dipropylene triamine, bishexamethylene triamine, bis-2-hydroxyethylethylene diamine, pentaethylylene hexamine, or hexaethylene heptamine, or any mixture thereof. The diacid can be a saturated aliphatic dibasic carboxylic acid, often containing from about 3 to about 10 carbon atoms or any mixture thereof. For example, the diacid can be or include malonic acid, succinic acid, glutaric acid, adipic acid, suberic acid, sebacic acid, or any mixture thereof.

To prepare a suitable prepolymer from the diacid and the polyalkylene polyamine, a mixture of the reactants can be heated at a temperature of about 110° C. to about 250° C., usually about 125° C. to about 200° C., and often about 160° C. to about 200° C., at atmospheric pressure. In carrying out the reaction, an amount of dicarboxylic acid sufficient to react substantially completely with the primary amine groups of the polyalkylene polyamine but insufficient to react with the secondary amine groups to any substantial extent can be used. The mole ratio of polyalkylene polyamine to dicarboxylic acid from about 0.9:1 to about 1.2:1. Where a reduced pressure is employed, lower temperatures such as about 75° C. to about 150° C. can be utilized. The time of reaction depends on the temperatures and pressures that are used and can ordinarily vary from about 0.5 hours to about 4 hours, although shorter or longer reaction times can be used depending on reaction conditions. This polycondensation reaction produces water as a byproduct, which is removed by distillation. At the end of this reaction, the resulting product usually is dissolved in water at a concentration of about 50 wt %, based on the total polymer solids.

Where a diester is used instead of a diacid for the reaction with the polyalkylene polyamine, the prepolymerization can be conducted at a lower temperature, preferably about 100° C. to about 175° C., under atmospheric pressure. In this case, the byproduct can be an alcohol, the type of alcohol depending upon the identity of the diester. For instance, where a dimethyl ester is employed the alcohol byproduct can be methanol, while ethanol can be the byproduct obtained from a diethyl ester. Where a reduced pressure is employed, lower temperatures such as about 75° C. to about 150° C. can be utilized.

Polyamidoamine prepolymers that can be used for producing a reactive, lightly crosslinked polyamidoamine-epihalohydrin polymer that would be suitable in a creping composition can be synthesized under conditions leading to the formation of a pre-polymer composition, which can have a weight average molecular weight from a low of about 10,000, about 30,000, or about 50,000 to a high of about 200,000 about 250,000, or about 300,000. For example, the polyamidoamine-epihalohydrin polymer can have a weight average molecular weight from about 10,000 to about 50,000, about 10,000 to about 50,000, about 50,000 to about 100,000, about 100,000 to about 150,000, about 150,000 to about 200,000, about 200,000 to about 250,000, or about 250,000 to about 300,000.

To produce a reactive, lightly crosslinked PAE suitable for preparing a creping composition, the amount of epihalohydrin introduced for reaction with the prepolymer can be controlled or limited. The mole ratio of epihalohydrin to secondary amine groups in the prepolymer can be less than 1.5:1, less the 1.2:1, or less than 1.1:1. For example, the mole ratio of epihalohydrin to the secondary amine groups in the polyamide prepolymer can be from about 0.05:1 to about 1.5:1, about 0.05:1 to about 1.25:1, about 0.5:1 to about 1.25:1.

As the available epihalohydrin, for example, epichlorohydrin, reacts with secondary amines distributed along the backbone of the polyamide prepolymer, the more reactive epoxide functionality can initially be consumed. This reaction thus results in a structure that has the covalently bound halogen such as chlorine, of the partially reacted epichlorohydrin available for further reaction with another secondary amine. When the terminal halogen, such as chlorine, functionality reacts with a secondary amine on another polyamide prepolymer molecule (that is, it participates in an alkylation reaction), a bridge (crosslink) is formed between the two polymer chains and a chloride ion (via hydrochloric acid formation) is formed that is captured by a tertiary nitrogen in the form of an ammonium salt. A composition containing only PAE resins with no residual reactive chlorine functionality is not self-reactive or thermosetting. In other words, the polymer is not self-crosslinkable. However, a PAE that is only lightly crosslinked with an epihalohydrin, such as with epichlorohydrin, and having no residual reactive chlorine functionality still likely has multiple secondary amine groups; it is similar to the structure of the initial prepolymer with just some additional branching or inter-chain crosslinking. Additional secondary amines would be present and available for reaction with any other reactive chlorine functionality from different molecules having residual covalent bonded halogens (co-crosslinking process).

If none of the halogen (chlorine) functionality of the epihalohydrin is consumed, then the PAE resin would not be crosslinked at all and the molecular weight and viscosity of the polyamide prepolymer would have changed very little by reaction with the epihalohydrin. Such a composition would be devoid of ionic chlorine and the total chlorine and covalent chlorine would be essentially the same. Such a composition represents the lower limit of a reactive, lightly crosslinked PAE resin. In other words, applicants consider a reactive PAE resin with no crosslinks at all to fall within the definition of lightly crosslinked, notwithstanding the possible difficulty or impracticality of being able to synthesize such material in practice. In one or more embodiments, some amount of crosslinking can generally be expected. In that case, the resulting polymer can have a measurable amount of both covalent halogen (for example, covalent chlorine), and ionic halogen (for example, ionic chlorine).

The ratio between the covalent chlorine and the ionic chlorine can depend to some extent on the ratio between epichlorohydrin and secondary amine and on the extent of the reaction conversion of covalent chlorine to ionic chlorine (crosslinking reaction). For example, the ionic chlorine/covalent chlorine ratio can also be altered by mixing two or more reactive, lightly crosslinked PAE resins, or by mixing one or more reactive, lightly crosslinked PAE resins with a PAE resin that is crosslinked more completely, such as a fully crosslinked (though generally lightly crosslinked) PAE resin.

A suitable PAE resin for an adhesive in the creping composition can include a crosslinked PAE. The crosslinked PAE can have a total chlorine content of from a low of about 0.1 wt %, about 1 wt %, or about 2 wt % to a high of about 8 wt %, about 9 wt %, or about 10 wt %, based on the total weight of the polymer solids and a covalent chlorine content of about 0.02 wt % to about 10 wt %, based on the weight of the polymer solids. More often, the total chlorine content can be between about 0.1 wt % and about 8 wt %, based on the weight of the polymer solids and the covalent chlorine content can be between 0.1 wt % and 6 wt %, based on the weight of the polymer solids. Even more often, the total chlorine content can be between about 0.1 wt % and about 6 wt %, based on the weight of the polymer solids, and especially between about 0.1 wt % and about 4 wt %, based on the weight of the polymer solids, and the covalent chlorine content can be between about 0.12 wt % and about 4 wt %, based on the weight of the polymer solids, and especially between about 0.15 wt % and about 3 wt %, based on the weight of the polymer solids. Most of the time, a lightly crosslinked PAE having a total chlorine content of about 0.1 wt % to about 3 wt %, based on the weight of the polymer solids and especially between about 0.1 wt % and about 2 wt %, based on the weight of the polymer solids, and a covalent chlorine content of about 0.15 wt % to about 2 wt %, based on the weight of the polymer solids and especially about 0.15 wt % to about 1.5 wt %, based on the weight of the polymer solids. The ionic chloride content of a PAE resin is the difference between the total chlorine content and the covalent chlorine content.

Since a suitable PAE resin for the creping composition can include a reactive, lightly crosslinked PAE resin, a certain amount of polymers in the composition can have residual pendant halohydrin, for example, chlorohydrin, functionality on the polymer backbone. This pendant halohydrin can be measured as covalent halogen (covalent chlorine). In suitable PAE resins for the creping composition, the ratio (either on a mole or weight basis) between pendant chlorohydrin groups (covalent chlorine) and crosslinks (ionic chlorine) in the composition can be from a low of about 0.01:1, about 0.1:1, or about 1:1 to a high of about 80:1 about 90:1, or about 100:1. For example, the ratio between pendant chlorohydrin groups (covalent chlorine) and crosslinks (ionic chlorine) can be from about 0.05:1 to about 10:1, about 0.05:1 to about 7.5:1, about 0.1:1 to about 5:1, about 2:1 to about 5:1, or about 7.5:1 to about 50:1.

In converting a polyamide prepolymer into a reactive, lightly crosslinked PAE, the prepolymer can be reacted with the epihalohydrin at a temperature from a low of about 0° C., about 10° C., or about 20° C. to a high of about 75° C., about 100° C., or about 120° C. For example, the prepolymer can be reacted with the epihalohydrin at a temperature of about 0° C. to about 25° C., about 25° C. to about 50° C., about 50° C. to about 80° C., or about 80° C. to about 120° C.

The extent of the reaction between the prepolymer and the epihalohydrin can be controlled so that the prepolymer is only lightly crosslinked with the epihalohydrin. The prepolymer can be reacted with the epihalohydrin until the viscosity of a 20 wt % solids solution at 25° C. has reached a gardener-Holdt viscosity of about C or higher. The viscosity for a 15 wt % solids solution can be less than about 150 centipoise (cP) at 25° C., as measured using a Brookfield viscometer. In another example, the viscosity of a 15 wt % solids solution can be at least about 5 cP (a viscosity of about A4 on the Gardner-Holdt scale) at 25° C. More often, the viscosity of the 15 wt % solids solution can be about 10 cP to about 60 cP (a viscosity of about A3 to AB on the Gardner-Holdt scale) at 25° C. The viscosity of the 15 wt % solids solution can be about 12 to about 25 cP (a viscosity of about A3 to A2 on the Gardner-Holdt scale) at 25° C.

The reaction between the polyamide prepolymer and the epihalohydrin can be carried out in aqueous solution to moderate the reaction. Although not necessary, pH adjustment can be done to increase or decrease the rate of residual crosslinking. When the desired viscosity is reached, sufficient water can be added to adjust the solids content of the lightly crosslinked PAE resin solution to a desired amount, for example, to about 15 wt % more or less; the product can be cooled to about 25° C. and then stabilized to permit storage. While the solids content of the lightly crosslinked PAE resin solution suitable for use as an adhesive is typically about 15 wt %, the solids content generally could range between 10% and 35 wt %. One can improve the stability of the lightly crosslinked PAE resin to resist gelation by adding sufficient acid to reduce the pH to less than about 6, usually to less than about 5, and most often to less than about 4. Any suitable inorganic or organic acid such as hydrochloric acid, sulfuric acid, methanesulfonic acid, nitric acid, formic acid, phosphoric acid and acetic acid can be used, as well as non-halogen containing acids, such as sulfuric acid.

The weight average molecular weight of the PAE resin compositions for the creping composition can be from about 60,000 up to about 1,000,000, more usually from about 150,000 to about 800,000, most often from about 300,000 to about 450,000. In particular, the reaction between the polyamide (for example, polyamidoamine) prepolymer and the halohydrin can have increased the molecular weight of prepolymers from 1.5 to 20 times, and usually from 2 to 10 times, from what it was originally. The weight average molecular weight for a reactive, lightly crosslinked PAE can be about 150,000 to about 800,000 and most often between 300,000 and 450,000.

Lightly crosslinked PAEs can have a viscosity at 25° C. of about 5 cPs to about 200 cPs (for example, 16 cPs); a solids content of about 8% to about 30% by weight (for example, 15%); a pH of about 2.5 to about 6.5 (for example, 4.7); an ionic chlorine content of about 0.05% to about 1.5% by weight (for example, about 0.35%); and/or a covalent chlorine content of about 0.01% to about 1.5% by weight (for example, about 0.1% to about 1.5% by weight or about 0.3% by weight).

The present disclosure is not limited to any specific manner for preparing a creping composition that includes a reactive, lightly crosslinked PAE resin. For example, to synthesize a single PAE that itself constitutes a reactive, lightly crosslinked PAE resin by using an appropriate amount of the epihalohydrin to synthesize the polymer from a suitable prepolymer and allowing the reaction to proceed until an intended balance of covalent chlorine and ionic chlorine is reached in the polymer composition. Alternatively, one can blend different PAEs having different levels of covalent chlorine and ionic chlorine to arrive at a composition having the intended balance between covalent chlorine and ionic chlorine. For example, one might blend a non-reactive, lightly crosslinked PAE resin, that is, a PAE resin which is fully crosslinked and in which the total chlorine and the ionic chlorine are substantially the same, with one or more separate PAE resins that is/are crosslinked very little, if at all, where the total chlorine and the covalent chlorine are substantially the same. Other options for blending PAE resins within the spectrum of different levels of crosslinking and different levels of reactivity can be apparent to those of ordinary skill in the art in view of the present disclosure.

The adhesion properties of the creping composition that includes a lightly crosslinked PAE can be systematically modified by varying the amount of crosslinking that can occur when the reactive, lightly crosslinked PAE is dried by heating in the presence of a reactive modifier. Because adhesive crosslink density influences adhesive mechanical properties, such as the glass transition temperature ($T_g$) of the adhesive, by varying the amount of crosslinking which can occur in the creping composition one can influence the level of adhesion of the fibrous cellulosic web onto the dryer surface, and accordingly one can control the relative ease or difficulty by which the fibrous substrate is released from the dryer surface. The amount of crosslinking can be varied by altering the extent by which the PAE is crosslinked during its preparation, and/or by altering the type and amount of the reactive modifier or other materials included in the creping composition.

The reactive modifiers can be compounds having a chemical structure similar to the adhesive itself (for example, similar to the prepolymer, amidoamine-based compounds, that form the foundation for the PAE), but having a much lower molecular weight. Thus, suitable reactive modifiers can have residual secondary and/or tertiary amine function. In particular, the weight average molecular weight of suitable reactive modifiers can be less than 5,000, less than 2,000, or less than 1,000. The lower limit for the reactive modifier's molecular weight is governed only by its volatility. The volatility of a reactive modifier cannot be so high such (the molecular weight cannot be so low) that the volatility of the reactive modifier interferes with the creping process. In particular, the reactive modifier is too volatile if heat associated with the creping process prevents a sufficient amount of the reactive modifier from being retained in the creping composition on the surface of the dryer during the creping operation, that is, if too much of the reactive modifier evaporates before it can influence the creping process then it is too volatile.

The reactive modifier can be a compound that can attenuate, inhibit, retard, or otherwise control the alkylation process (for example, by the formation of crosslinks by reaction between secondary amine moieties and pendant halohydrin moieties) by reacting with covalent halogen (chlorine) without causing a significant increase in the adhesive PAE resin molecular weight. Thus, the reactive modifier provides a way to control the crosslinking process. Suitable reactive modifiers can be capable of reacting with pendant halohydrin, chlorohydrin, moieties on the reactive, lightly crosslinked PAE. Suitable reactive modifiers also can function as plasticizers for the PAE adhesive as well. The reactive modifier can be added to either the creping composition (that is, to the reactive, lightly crosslinked PAE) or to a release aid, or could be applied independently to the dryer surface during the creping process. Blends of different reactive modifiers also can be used along with some other plasticizers (such as di-ethanol amine, tri-ethanol amine, glycerin or polyglycerin) for mixture with the creping composition.)

Suitable reactive modifiers can be produced by a reaction between a polyalkylenepolyamine, such as DETA (diethylenetriamine) or N-methyl-3,3'-diaminopropylamine (NMDAPA), and 2 moles of an electrophile such as a carboxylic acid, for example, acetic acid (AcA), methylene-bis-acrylamide (MBA) or urea. Adducts based on DETA, for example, can retain residual secondary amine functionality, which can be further reacted with an additional electrophile, such as acrylamide (AAm), epichlorohydrin (Epi), or propylene glycoldiglycidalether (PGDGE) to create tertiary amines. Conditions suitable for preparing reactive modifiers from these materials can include those discussed and described in U.S. Patent Application Publication No. 2011/0284176. Other suitable conditions can be apparent to those skilled in the art.

A cellulosic fiber web can be creped in the dryer by applying the creping composition at a first temperature to a drying surface at a second temperature. The second temperature can be greater than the first temperature. A cellulosic fiber web can be applied or otherwise contacted to the drying surface such that the cellulosic fiber web adheres to the drying surface. The cellulosic fiber web can be dislodged from the drying surface. The cloud point of the creping composition can be above the first temperature and below the second temperature. The release aid and the adhesive can be applied to the drying surface of the Yankee dryer individually or as a mixture, i.e., as the creping composition.

In one or more embodiments, the first temperature can be from a low of about 20° C., about 25° C., about 30° C., about 40° C., about 50° C., or about 60° C. to a high of about 70° C., about 80° C., about 85° C., about 90° C., or about 95° C. For example, the first temperature can be about 20° C. to about 35° C., about 25° C. to about 45° C., about 30° C. to about 55° C., about 35° C. to about 60° C., about 40° C. to about 75° C., about 45° C. to about 85° C., about 50° C. to about 75° C., about 50° C. to about 90° C., about 55° C. to about 80° C., or about 35° C. to about 75° C. The second temperature, which can be greater than the first temperature, can be from a low of about 70° C., about 75° C., about 80° C., about 85° C., about 90° C., or about 95° C. to a high of about 100° C., about 105° C., about 110° C., about 115° C., about 120° C., about 130° C., about 140° C., about 150° C., about 160°, about 170° C., about 180° C., about 190° C., or about 200° C. In one or more embodiments, the first temperature can be about 25° C. to about 95° C. and the second temperature can be from about 50° C. to about 200° C., where the second temperature is greater than the first temperature. In one or more embodiments, the first temperature can be about 25° C. to about 85° C. and the second temperature can be from about 80° C. to about 150° C., where the second temperature is greater than the first temperature. In one or more embodiments, the first temperature can be about 25° C. to about 60° C. and the second temperature can be from about 90° C. to about 140° C.

In one or more embodiments, the second temperature can be at least 5° C. greater, at least 10° C. greater, at least 20° C. greater, at least 30° C. greater, at least 40° C. greater, at least 50° C. greater, at least 60° C. greater, at least 70° C. greater, at least 80° C. greater, at least 90° C. greater, at least 100° C. greater, at least 110° C. greater, at least 120° C. greater, or at least 130° C. greater than the first temperature. For example, if the first temperature is about 60° C., a second temperature that is at least 50° C. greater than the first temperature would be a temperature of at least 110° C. In one or more embodiments, a temperature differential between the first temperature and the second temperature can be from a low of about 1° C., about 5° C., about 10° C., about 15° C., about 20° C., about 25° C., about 30° C., about 35° C., about 40° C., or about 45° C. to a high of about 50° C., about 60° C., about 70° C., about 80° C., about 90° C., about 100° C., about 110° C., about 120° C., about 130° C., about 140° C., about 150° C., about 160° C., about 170° C., about 180° C., or about 190° C. For example, the temperature differential between the first temperature and the second temperature can be about 5° C. to about 25° C., about 15° C. to about 40° C., about 25° C. to about 50° C., about 30° C. to about 60° C., about 40° C. to about 70° C., about 45° C. to about 85° C., about 50° C. to about 100° C., about 50° C. to about 80° C., about 60° C. to about 110° C., about 70° C. to about 120° C., or about 80° C. to about 150° C.

By adjusting the composition and operational parameters such that the cloud point of the creping composition is above the first temperature and below the second temperature, clouding can occur at the temperature of the dry surface, which can provide an oil-like effect and boost the efficiency of the release. As such, the composition and operational parameters can be tailored so that the components of the creping composition can undergo a change in phase structure and distribution upon a temperature change or a dilution that effectively occurs following application to the surface of the drier while in contact with the adhesive. This method of creping can also involve other reactions that at take place at dryer temperatures on the dryer surface under the controlled conditions of the dryer. For example, the creping composition can undergo reactions, e.g., a thermosetting reaction, when on the dryer surface.

The adhesive and the release aids can be applied together or separately to the drying surface. The drying surface onto which the creping composition is applied can be, for example, the drying surface of a Yankee Dryer or the drying surface of a through air drying (TAD) process. The applying step can include applying the creping composition having a first temperature to a drying surface having a second temperature, where the second temperature is higher than the first temperature such that the cloud point of the creping composition is reached or exceeded at the second temperature. The release aid can cloud or cloud out at the second temperature to provide or enhance the release mechanism.

The terms "cellulosic fiber web, fibrous web, tissue paper web, paper web, web and cellulosic fiber product" all refer to sheets of paper made by a process which can include forming a papermaking furnish, depositing the furnish onto a foraminous surface, removing water from the web (by gravity or vacuum-assisted drainage, with or without pressing, and by evaporation), and the steps of adhering the sheet in a semi-dry condition to a heated drying surface, such as a Yankee Dryer, completing the water removal by evaporation to an essentially dry state, removing the sheet by a creping blade such as a doctor blade, and winding the resultant sheet onto a reel. The moisture content of the web sheet, for example, paper, delivered to the creping equipment can be between 5 wt % and 85 wt %. The web can include any one or more type of natural and/or recycled fibers including wood pulps of chemical and mechanical types. The web can be composed of up to 100% recycled fibers. The fibers can comprise hardwood, softwood and cotton fibers. The tissue web can also contain particulate fillers, fines, as well as process chemicals used in the papermaking process such as strength additives, softeners, surfactants and organic polymers.

The creping composition can be applied to the drying surface in an amount from 0.01 lb/ton to 2.2 lb/ton based on the dry weight of the creping composition and the dry weight of the cellulosic fiber being creped. The cellulosic fiber web can have a content of recycled fibers of from about 1 wt % to about 100 wt %, based on the total weight of cellulosic fiber web. The cellulosic fiber web can have a moisture content from about 5 wt % to about 85 wt %, based on the total weight of cellulosic fiber web.

EXAMPLES

In order to provide a better understanding of the foregoing discussion, the following non-limiting examples are offered. Although the examples can be directed to specific embodiments, they are not to be viewed as limiting the invention in any specific respect.

A polyethylene oxide (PEO) polymer ($M_w$=400) was Blended with a Polyvinyl Alcohol (PVA) polymer (about 30 wt % based on the weight of the PEO) to produce a release aid. The release aid had a total solids concentration of about 10 wt %. A precipitate formed at a temperature of about 25° C. and at an atmospheric pressure of about 101 kPa. The release aid was diluted with water to provide an aqueous mixture that had a concentration of the release aid of about 3 vol %, based on the total volume of the release aid and water. The cloud point of the aqueous mixture increased from room temperature toward 100° C. at the atmospheric pressure of about 101 kPa.

A block-copolymer of ethylene oxide and propylene oxide (EO-PO-EO) (about 82% EO) was mixed with 0.8% polyvinyl alcohol (PVA) (87% hydrolysis) at a 6.6 block-copolymer/PVA ratio to produce a release aid. A precipitate was formed at a temperature of about 25° C. and at an atmospheric pressure of about 101 kPa. The release aid was diluted with water to produce an aqueous mixture. When the release aid included less than 6.1 vol % of a combined amount of the block-copolymer and the polyvinyl alcohol, the cloud point of the release aid increased toward 100° C. at the atmospheric pressure of about 101 kPa.

Embodiments of the present disclosure further relate to any one or more of the following paragraphs:

1. A method for making a cellulosic fiber web, comprising: applying a release aid having a first temperature to a drying surface having a second temperature; adhering a cellulosic fiber web to the drying surface by contacting the cellulosic fiber to the drying surface; and dislodging the cellulosic fiber web from the drying surface, wherein: the second temperature is greater than the first temperature, the release aid has a cloud point that is greater than the first temperature and less than the second temperature, the release aid comprises a polyether and a hydrophilic polymer, the polyether comprises a polyethylene glycol, a polypropylene glycol, a copolymer of propylene glycol and ethylene glycol, a blend of polypropylene glycol and polyethylene glycol, an alcohol polyether, an alkyl phenol polyether, or any mixture thereof, and the hydrophilic polymer comprises a polyvinyl alcohol, a starch, a tannin, a lignin, a novolac resin, a polyacrylic acid, a copolymer of acrylic acid, a copolymer of methacrylic acid, a copolymer of itaconic acid, a copolymer of maleic anhydride, carboxymethyl cellulose, or any mixture thereof.

2. A method for making a cellulosic fiber web, comprising: applying a creping composition having a first temperature to a drying surface having a second temperature; adhering a cellulosic fiber web to the drying surface by contacting the cellulosic fiber web to the drying surface; and dislodging the cellulosic fiber web from the drying surface, wherein: the second temperature is greater than the first temperature, the creping composition has a cloud point that is greater than the first temperature and less than the second temperature, the creping composition comprises a release aid and an adhesive, the release aid comprises a polyether and a hydrophilic polymer, the polyether comprises a polyethylene glycol, a polypropylene glycol, a copolymer of propylene glycol and ethylene glycol, a blend of polypropylene glycol and polyethylene glycol, an alcohol polyether, an alkyl phenol polyether, or any mixture thereof, the hydrophilic polymer comprises a polyvinyl alcohol, a starch, a tannin, a lignin, a novolac resin, a polyacrylic acid, a copolymer of acrylic acid, a copolymers of methacrylic acid, a copolymer of itaconic acid, a copolymer of maleic anhydride, carboxymethyl cellulose, or any mixture thereof, and the adhesive comprises a polyamine-epihalohydrin resin, an acrylonitrile copolymer grafted onto cellulose, a polyvinyl alcohol, an aromatic polyamidoamine, a polyvinyl amine, a glyoxalated polyacrylamide, a polyamine, a copolymer of styrene-methacrylic acid, or any mixture thereof.

3. A creped product, comprising: a creped cellulosic fiber web comprising a creping composition containing an at least partially cured adhesive, wherein, prior to curing, the creping composition comprises a release aid and an adhesive, wherein: the release aid comprises a polyether and a hydrophilic polymer, the polyether comprises a polyethylene glycol, a polypropylene glycol, a copolymer of propylene glycol and ethylene glycol, a blend of polypropylene glycol and polyethylene glycol, an alcohol polyether, an alkyl phenol polyether, or any mixture thereof, the hydrophilic polymer comprises a polyvinyl alcohol, a starch, a tannin, a lignin, a novolac resin, a polyacrylic acid, a copolymer of acrylic acid, a copolymer of methacrylic acid, a copolymer of itaconic acid, a copolymer of maleic anhydride, a carboxymethyl cellulose, or any mixture thereof, and the adhesive comprises a polyamine-epihalohydrin resin, an acrylonitrile copolymer grafted onto cellulose, a polyvinyl alcohol, an aromatic polyamidoamine, a polyvinyl amine, a glyoxalated polyacrylamide, a polyamine, a copolymer of styrene-methacrylic acid, or any mixture thereof.

4. A release aid, comprising: a polyether and a hydrophilic polymer, wherein the polyether comprises a polyethylene glycol, a polypropylene glycol, a copolymer of propylene glycol and ethylene glycol, a blend of polypropylene glycol and polyethylene glycol, an alcohol polyether, an alkyl phenol polyether, or any mixture thereof, and wherein the hydrophilic polymer comprises a polyvinyl alcohol, a starch, a tannin, a lignin, a novolac resin, a polyacrylic acid, a copolymer of acrylic acid, a copolymer of methacrylic acid, a copolymer of itaconic acid, a copolymer of maleic anhydride, carboxymethyl cellulose, or any mixture thereof.

5. A creping composition, comprising: a release aid and an adhesive, wherein the release aid comprises a polyether and a hydrophilic polymer, wherein the polyether comprises a polyethylene glycol, a polypropylene glycol, a copolymer of propylene glycol and ethylene glycol, a blend of polypropylene glycol and polyethylene glycol, an alcohol polyether, an alkyl phenol polyether, or any mixture thereof, wherein the hydrophilic polymer comprises a polyvinyl alcohol, a starch, a tannin, a lignin, a novolac resin, a polyacrylic acid, a copolymer of acrylic acid, a copolymer of methacrylic acid, a copolymer of itaconic acid, a copolymer of maleic anhydride, carboxymethyl cellulose, or any mixture thereof, and wherein the adhesive comprises a polyamine-epihalohydrin resin, an acrylonitrile copolymer grafted onto cellulose, a polyvinyl alcohol, an aromatic polyamidoamine, a polyvinyl amine, a glyoxalated polyacrylamide, a polyamine, a copolymer of styrene-methacrylic acid, or any mixture thereof.

6. A method for making a cellulosic fiber web, comprising: applying a release aid having a first temperature to a drying surface having a second temperature; adhering a cellulosic fiber web to the drying surface by contacting the cellulosic fiber to the drying surface; and dislodging the cellulosic fiber web from the drying surface, wherein: the second temperature is greater than the first temperature; the release aid, in an aqueous solution that includes water and about 3 vol % of the release aid based on the total volume of the release aid and water, has a cloud point that is greater than the first temperature and less than the second temperature at a pressure of 100 kPa; the release aid comprises a polyether and a hydrophilic polymer; the polyether comprises a polyethylene glycol, a polypropylene glycol, a copolymer of propylene glycol and ethylene glycol, a blend of polypropylene glycol and polyethylene glycol, an alcohol polyether, an alkyl phenol polyether, or any mixture thereof; and the hydrophilic polymer comprises a polyvinyl alcohol, a starch, a tannin, a lignin, a novolac resin, a polyacrylic acid, a copolymer of acrylic acid, a copolymer of methacrylic acid, a copolymer of itaconic acid, a copolymer of maleic anhydride, carboxymethyl cellulose, or any mixture thereof.

7. A method for making a cellulosic fiber web, comprising: applying a creping composition having a first temperature to a drying surface having a second temperature; adhering a cellulosic fiber web to the drying surface by contacting the cellulosic fiber web to the drying surface; and dislodging the cellulosic fiber web from the drying surface, wherein: the second temperature is greater than the first temperature; the creping composition comprises a release aid and an adhesive; the release aid, in an aqueous solution that includes water and about 3 vol % of the release aid based on the total volume of the release aid and water, has a cloud point that is greater than the first temperature and less than the second temperature at a pressure of 100 kPa; the release aid comprises a polyether and a hydrophilic polymer; the polyether comprises a polyethylene glycol, a polypropylene glycol, a copolymer of propylene glycol and ethylene glycol, a blend of polypropylene glycol and polyethylene glycol, an alcohol polyether, an alkyl phenol polyether, or any mixture thereof the hydrophilic polymer comprises a polyvinyl alcohol, a starch, a tannin, a lignin, a novolac resin, a polyacrylic acid, a copolymer of acrylic acid, a copolymers of methacrylic acid, a copolymer of itaconic acid, a copolymer of maleic anhydride, carboxymethyl cellulose, or any mixture thereof and the adhesive comprises a polyamine-epihalohydrin resin, an acrylonitrile copolymer grafted onto cellulose, a polyvinyl alcohol, an aromatic polyamidoamine, a polyvinyl amine, a glyoxalated polyacrylamide, a polyamine, a copolymer of styrene-methacrylic acid, or any mixture thereof.

8. The method, creped product, release aid, or creping composition according to any one of paragraphs 1 to 7, wherein the hydrophilic polymer comprises the polyvinyl alcohol, the starch, or a mixture thereof.

9. The method, creped product, release aid, or creping composition according to any one of paragraphs 1 to 8, wherein the hydrophilic polymer comprises the tannin, the lignin, the novolac resin, or any mixture thereof.

10. The method, creped product, release aid, or creping composition according to any one of paragraphs 1 to 9, wherein the hydrophilic polymer comprises the polyacrylic acid, the copolymer of acrylic acid, the copolymer of methacrylic acid, the copolymer of itaconic acid, the copolymer of maleic anhydride, carboxymethyl cellulose, or any mixture thereof.

11. The method, creped product, release aid, or creping composition according to any one of paragraphs 1 to 10, wherein a weight ratio of the polyether to the hydrophilic polymer is about 50:50 to about 80:20.

12. The method, creped product, release aid, or creping composition according to any one of paragraphs 1 to 10, wherein a weight ratio of the polyether to the hydrophilic polymer is about 20:80 to about 50:50.

13. The method, creped product, release aid, or creping composition according to any one of paragraphs 1 to 10, wherein a weight ratio of the polyether to the hydrophilic polymer is about 70:30 to about 60:40.

14. The method, creped product, release aid, or creping composition according to any one of paragraphs 1 to 10, wherein a weight ratio of the polyether to the hydrophilic polymer is about 75:25 to about 65:35.

15. The method, creped product, release aid, or creping composition according to any one of paragraphs 1 to 14, wherein the release aid, in an aqueous solution that includes about 3 vol % of the release aid, based on the total volume of the release aid and water, has a cloud point of about 1° C. to about 98° C., at a pressure of 100 kPa.

16. The method, creped product, release aid, or creping composition according to any one of paragraphs 1 to 14, wherein the release aid, in an aqueous solution that includes about 3 vol % of the release aid, based on the total volume of the release aid and water, has a cloud point of about 50° C. to about 98° C., at a pressure of 100 kPa.

17. The method, creped product, release aid, or creping composition according to any one of paragraphs 1 to 14, wherein the release aid, in an aqueous solution that includes about 3 vol % of the release aid, based on the total volume of the release aid and water, has a cloud point of about 60° C. to about 98° C., at a pressure of 100 kPa.

18. The method, creped product, release aid, or creping composition according to any one of paragraphs 1 to 14, wherein the release aid, in an aqueous solution that includes about 3 vol % of the release aid, based on the total volume of the release aid and water, has a cloud point of about 55° C. to about 95° C., at a pressure of 100 kPa.

19. The method, creped product, release aid, or creping composition according to any one of paragraphs 1 to 14, wherein the release aid, in an aqueous solution that includes about 3 vol % of the release aid, based on the total volume of the release aid and water, has a cloud point of about 60° C. to about 90° C., at a pressure of 100 kPa.

20. The method, creped product, release aid, or creping composition according to any one of paragraphs 1 to 19, wherein the polyether comprises the polypropylene glycol, and wherein the polypropylene glycol has a weight average molecular weight of about 400 to about 3,500.

21. The method according to any one of paragraphs 1, 6, or 8 to 20, further comprising applying an adhesive to the drying surface, wherein the adhesive comprises a polyamine-epihalohydrin resin, an acrylonitrile copolymer grafted onto cellulose, a polyvinyl alcohol, an aromatic polyamidoamine, a polyvinyl amine, a glyoxalated polyacrylamide, a polyamine, a copolymer of styrene-methacrylic acid, or any mixture thereof.

22. The method, creped product, release aid, or creping composition according to any one of paragraphs 1 to 21, wherein the release aid further comprises a compound having the formula:

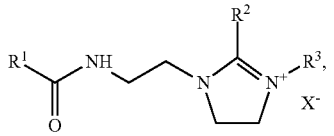

wherein $R^1$ and $R^2$ are independently a $(C_6\text{-}C_{22})$alkyl, wherein $R^3$ is a methyl or an ethyl, and wherein $X^-$ is the counter ion $[SO_4]^-$.

23. The method, creped product, release aid, or creping composition according to any one of paragraphs 1 to 22, wherein the release aid further comprises a compound having the formula:

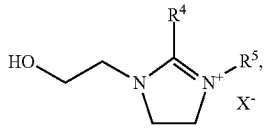

wherein $R^4$ is a $(C_6\text{-}C_{22})$alkyl, wherein $R^5$ is a methyl or an ethyl, and wherein $X^-$ is the counter ion $[SO_4]^-$.

24. The method, creped product, release aid, or creping composition according to any one of paragraphs 1 to 23, wherein the release aid further comprises a compound having the formula:

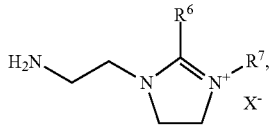

wherein $R^6$ is a $(C_6\text{-}C_{22})$alkyl, wherein $R^7$ is a methyl or an ethyl, and wherein $X^-$ is the counter ion $[SO_4]^-$.

25. The method, creped product, release aid, or creping composition according to any one of paragraphs 1 to 24, wherein the release aid further comprises a quaternary imidazoline compound, an imidazoline free base, an oil-based dispersion, or mixtures thereof.

26. The method, creped product, release aid, or creping composition according to any one of paragraphs 1 to 25, wherein the polyether comprises the copolymer of propylene glycol and ethylene glycol.

27. The method, creped product, release aid, or creping composition according to paragraph 26, wherein the copolymer of propylene glycol and ethylene glycol is a block copolymer.

28. The method, creped product, release aid, or creping composition according to paragraph 27, wherein the block copolymer has a weight average molecular weight of about 300 to about 4,000.

29. The method, creped product, release aid, or creping composition according to any one of paragraphs 26 to 28, wherein a weight ratio of polypropylene glycol monomer residues to polyethylene glycol monomer residues is about 20:1 to about 1:5.

30. The method, creped product, or creping composition according to any one of paragraphs 2, 3, 5, or 7 to 29, wherein the release aid is mixed with the adhesive to produce the creping composition, and wherein the polyether and the hydrophilic polymer are mixed for a time period of at least 30 seconds to about 30 minutes to produce the release aid before the release aid is mixed with the adhesive to produce the creping composition.

31. The method, creped product, release aid, or creping composition according to any one of paragraphs 1 to 30, wherein the hydrophilic polymer comprises the polyvinyl alcohol.

32. The method, creped product, release aid, or creping composition according to any one of paragraphs 1 to 31, wherein the polyether comprises polyethylene glycol.

33. The method, creped product, or creping composition according to any one of paragraphs 2, 3, or 5 to 32, wherein the adhesive comprises a polyamine-epihalohydrin resin.

34. The method, creped product, release aid, or creping composition according to any one of paragraphs 1 to 33, wherein the release aid has a water concentration of about 5 wt % to about 65 wt %, based on the total weight of the polyether, the hydrophilic polymer, and the water.

35. The method, creped product, release aid, or creping composition according to any one of paragraphs 1 to 34, wherein the release aid has a total solids concentration of about 1 wt % to about 99 wt %.

36. The method according to any one of paragraphs 1, 2, or 6 to 35, wherein the first temperature is about 20° C. to about 95° C.

37. The method according to any one of paragraphs 1, 2, or 6 to 36, wherein the second temperature is about 70° C. to about 200° C.

38. The method according to any one of paragraphs 1, 2, or 6 to 35, wherein the first temperature is about 20° C. to about 60° C., and wherein the second temperature is about 65° C. to about 150° C.

39. The method according to any one of paragraphs 1, 2, or 6 to 35, wherein the first temperature is about 25° C. to about 95° C., and wherein the second temperature is about 70° C. to about 150° C.

40. The method, creped product, release aid, or creping composition according to any one of paragraphs 1 to 39, wherein the release aid further comprises water, and wherein the release aid comprises about 1 vol % to about 99 vol % of a combined amount of the polyether and the hydrophilic polymer, based on the total volume of the polyether, the hydrophilic polymer, and the water.

41. The method, creped product, release aid, or creping composition according to any one of paragraphs 1 to 39, wherein the release aid further comprises water, and wherein the release aid comprises about 1 vol % to about 20 vol % of a combined amount of the polyether and the hydrophilic polymer, based on the total volume of the polyether, the hydrophilic polymer, and the water.

42. The method, creped product, release aid, or creping composition according to any one of paragraphs 1 to 39, wherein the release aid further comprises water, and wherein the release aid comprises about 1 vol % to about 10 vol % of a combined amount of the polyether and the hydrophilic polymer, based on the total volume of the polyether, the hydrophilic polymer, and the water.

43. The method, creped product, release aid, or creping composition according to any one of paragraphs 1 to 39, wherein the release aid further comprises water, and wherein the release aid comprises about 2 vol % to about 4 vol % of a combined amount of the polyether and the hydrophilic polymer, based on the total volume of the polyether, the hydrophilic polymer, and the water.

44. The method, creped product, release aid, or creping composition according to any one of paragraphs 1 to 39, wherein the release aid further comprises water, and wherein the release aid comprises about 3 vol % to about 8 vol % of a combined amount of the polyether and the hydrophilic polymer, based on the total volume of the polyether, the hydrophilic polymer, and the water.

45. The method, creped product, release aid, or creping composition according to any one of paragraphs 1 to 39, wherein the release aid further comprises water, and wherein the release aid comprises less than 10 vol % of a combined amount of the polyether and the hydrophilic polymer, based on the total volume of the polyether, the hydrophilic polymer, and the water.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A method for making a cellulosic fiber web, comprising:

applying a release aid having a first temperature to a drying surface having a second temperature;

adhering a cellulosic fiber web to the drying surface by contacting the cellulosic fiber to the drying surface; and dislodging the cellulosic fiber web from the drying surface, wherein:

the second temperature is greater than the first temperature, the release aid, in an aqueous solution that includes water and about 3 vol % of the release aid based on the total volume of the release aid and water, has a cloud point that is greater than the first temperature and less than the second temperature at a pressure of 100 kPa, the release aid comprises a polyether and a hydrophilic polymer, the polyether comprises a polyethylene glycol, a polypropylene glycol, a copolymer of propylene glycol and ethylene glycol, a blend of polypropylene glycol and polyethylene glycol, an alcohol polyether, an alkyl phenol polyether, or any mixture thereof, and the hydrophilic polymer comprises a polyvinyl alcohol, a starch, a tannin, a lignin, a novolac resin, a polyacrylic acid, a copolymer of acrylic acid, a copolymer of methacrylic acid, a copolymer of itaconic acid, a copolymer of maleic anhydride, carboxymethyl cellulose, or any mixture thereof.

2. The method of claim 1, wherein the hydrophilic polymer comprises the polyvinyl alcohol, the starch, or a mixture thereof.

3. The method of claim 1, wherein the hydrophilic polymer comprises the tannin, the lignin, the novolac resin, or any mixture thereof.

4. The method of claim 1, wherein the hydrophilic polymer comprises the polyacrylic acid, the copolymer of acrylic acid, the copolymer of methacrylic acid, the copolymer of itaconic acid, the copolymer of maleic anhydride, carboxymethyl cellulose, or any mixture thereof.

5. The method of claim 1, wherein a weight ratio of the polyether to the hydrophilic polymer is about 70:30 to about 60:40.

6. The method of claim 1, wherein the release aid, in an aqueous solution that includes water and about 3 vol % of the release aid based on the total volume of the release aid and water, has a cloud point of about 1° C. to about 98° C., at a pressure of 100 kPa.

7. The method of claim 1, wherein the polyether comprises the polypropylene glycol, and wherein the polypropylene glycol has a weight average molecular weight of about 400 to about 3,500.

8. The method of claim 1, further comprising applying an adhesive to the drying surface, wherein the adhesive comprises a polyamine-epihalohydrin resin, an acrylonitrile copolymer grafted onto cellulose, a polyvinyl alcohol, an aromatic polyamidoamine, a polyvinyl amine, a glyoxalated polyacrylamide, a polyamine, a copolymer of styrene-methacrylic acid, or any mixture thereof.

9. The method of claim 1, wherein the release aid further comprises a compound having the formula:

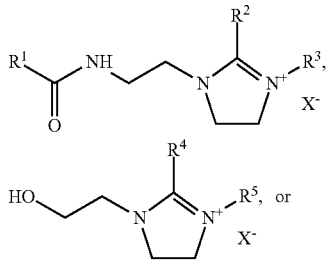

-continued

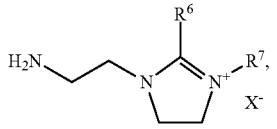

wherein $R^1$, $R^2$, $R^4$, and $R^6$ are independently a ($C_6$-$C_{22}$) alkyl, wherein $R^3$, $R^5$, and $R^7$ are independently a methyl or an ethyl, and wherein $X^-$ is the counter ion $[SO_4]^-$.

10. A method for making a cellulosic fiber web, comprising:

applying a creping composition having a first temperature to a drying surface having a second temperature;

adhering a cellulosic fiber web to the drying surface by contacting the cellulosic fiber web to the drying surface; and dislodging the cellulosic fiber web from the drying surface, wherein:

the second temperature is greater than the first temperature, the creping composition comprises a release aid and an adhesive, the release aid, in an aqueous solution that includes water and about 3 vol % of the release aid based on the total volume of the release aid and water, has a cloud point that is greater than the first temperature and less than the second temperature at a pressure of 100 kPa, the release aid comprises a polyether and a hydrophilic polymer, the polyether comprises a polyethylene glycol, a polypropylene glycol, a copolymer of propylene glycol and ethylene glycol, a blend of polypropylene glycol and polyethylene glycol, an alcohol polyether, an alkyl phenol polyether, or any mixture thereof, the hydrophilic polymer comprises a polyvinyl alcohol, a starch, a tannin, a lignin, a novolac resin, a polyacrylic acid, a copolymer of acrylic acid, a copolymers of methacrylic acid, a copolymer of itaconic acid, a copolymer of maleic anhydride, carboxymethyl cellulose, or any mixture thereof, and the adhesive comprises a polyamine-epihalohydrin resin, an acrylonitrile copolymer grafted onto cellulose, a polyvinyl alcohol, an aromatic polyamidoamine, a polyvinyl amine, a glyoxalated polyacrylamide, a polyamine, a copolymer of styrene-methacrylic acid, or any mixture thereof.

11. The method of claim 10, wherein the hydrophilic polymer comprises the polyvinyl alcohol, the starch, or a mixture thereof.

12. The method of claim 10, wherein the first temperature is about 25° C. to about 95° C., and wherein the second temperature is about 70° C. to about 150° C.

13. The method of claim 10, wherein the hydrophilic polymer comprises the polyacrylic acid, the copolymer of acrylic acid, the copolymer of methacrylic acid, the copolymer of itaconic acid, the copolymer of maleic anhydride, the carboxymethyl cellulose, or any mixture thereof.

14. The method of claim 10, wherein a weight ratio of the polyether and the hydrophilic polymer is about 70:30 to about 60:40.

15. The method of claim 10, wherein the release aid, in an aqueous solution that includes water and about 3 vol % of the release aid based on the total volume of the release aid and water, has a cloud point of about 1° C. to about 98° C., at a pressure of 100 kPa.

16. The method of claim 10, wherein the polyether comprises the polypropylene glycol, and wherein the polypropylene glycol has a weight average molecular weight of about 400 to about 3,500.

17. The method of claim 10, wherein the polyether comprises the copolymer of propylene glycol and ethylene glycol, wherein the copolymer of propylene glycol and ethylene glycol is a block copolymer, wherein the block copolymer has a weight average molecular weight of about 300 to about 4,000, and wherein a weight ratio of polypropylene glycol monomer residues to polyethylene glycol monomer residues is about 20:1 to about 1:5.

18. The method of claim 10, wherein the release aid further comprises a compound having the formula:

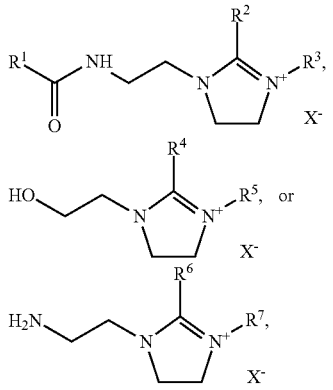

wherein $R^1$, $R^2$, $R^4$, and $R^6$ are independently a ($C_6$-$C_{22}$) alkyl, wherein $R^3$, $R^5$, and $R^7$ are independently a methyl or an ethyl, and wherein $X^-$ is the counter ion $[SO_4]^-$.

19. The method of claim 10, wherein:

the polyether comprises the polyethylene glycol, the polypropylene glycol, the copolymer of propylene glycol and ethylene glycol, or any mixture thereof, the polyether has a weight average molecular weight of about 300 to about 3,500, the hydrophilic polymer comprises the polyvinyl alcohol, the release aid, in an aqueous solution that includes about 3 vol % of the release aid, based on the total volume of the release aid and water, has a cloud point of about 1° C. to about 98° C., at a pressure of about 100 kPa, a weight ratio of the polyether and the hydrophilic polymer is about 75:25 to about 65:35, the adhesive comprises the polyamine-epihalohydrin resin, the release aid is mixed with the adhesive to produce the creping composition, and the polyether and a hydrophilic polymer are mixed for a time period of at least 30 seconds to about 30 minutes to produce the release aid before the release aid is mixed with the adhesive to produce the creping composition.

20. A creped product, comprising:

a creped cellulosic fiber web comprising a creping composition containing an at least partially cured adhesive, wherein, prior to curing, the creping composition comprises a release aid and an adhesive, wherein:

the release aid comprises a polyether and a hydrophilic polymer, the polyether comprises a polyethylene glycol, a polypropylene glycol, a copolymer of propylene glycol and ethylene glycol, a blend of polypropylene glycol and polyethylene glycol, an alcohol polyether, an alkyl phenol polyether, or any mixture thereof, the hydrophilic polymer comprises a polyvinyl alcohol, a starch, a tannin, a lignin, a novolac resin, a polyacrylic acid, a copolymer of acrylic acid, a copolymer of methacrylic acid, a copolymer of itaconic acid, a copolymer of maleic anhydride, a carboxymethyl cellulose, or any mixture thereof, and the adhesive comprises a polyamine-epihalohydrin resin, an acrylonitrile copolymer grafted onto cellulose, a polyvinyl alcohol, an aromatic polyamidoamine, a polyvinyl amine, a glyoxalated polyacrylamide, a polyamine, a copolymer of styrene-methacrylic acid, or any mixture thereof.

* * * * *